US008342112B2

(12) United States Patent
Fujihara

(10) Patent No.: US 8,342,112 B2
(45) Date of Patent: Jan. 1, 2013

(54) SEWING MACHINE AND COMPUTER-READABLE MEDIUM STORING SEWING MACHINE CONTROL PROGRAM

(75) Inventor: Shinya Fujihara, Obu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 223 days.

(21) Appl. No.: 12/847,550

(22) Filed: Jul. 30, 2010

(65) Prior Publication Data

US 2011/0041743 A1 Feb. 24, 2011

(30) Foreign Application Priority Data

Aug. 21, 2009 (JP) ..... 2009-191580

(51) Int. Cl.
*D05B 19/00* (2006.01)
*D05B 23/00* (2006.01)

(52) U.S. Cl. ..... 112/470.04; 700/136; 396/310

(58) Field of Classification Search ..... 112/470.01–470.18, 271, 274, 112/217.2, 260; 700/136–138; 396/310, 396/315, 321
See application file for complete search history.

(56) References Cited

U.S. PATENT DOCUMENTS

| | | | | |
|---|---|---|---|---|
| 4,784,071 | A * | 11/1988 | Sadeh et al. | 112/470.07 |
| 4,798,152 | A * | 1/1989 | Simons et al. | 112/470.05 |
| 4,998,489 | A | 3/1991 | Hisatake et al. | |
| 5,027,726 | A * | 7/1991 | Brower et al. | 112/117 |
| 5,323,722 | A | 6/1994 | Goto et al. | |
| 5,911,182 | A | 6/1999 | Uyama et al. | |
| 6,263,815 | B1 * | 7/2001 | Furudate | 112/470.13 |
| 7,325,502 | B2 * | 2/2008 | Konig et al. | 112/475.02 |
| 2002/0157588 | A1 * | 10/2002 | Musco et al. | 112/475.02 |
| 2007/0227420 | A1 | 10/2007 | Suzuki et al. | |
| 2010/0236463 | A1 | 9/2010 | Fujihara et al. | |

FOREIGN PATENT DOCUMENTS

| | | |
|---|---|---|
| JP | A-02-057288 | 2/1990 |
| JP | A-04-364884 | 12/1992 |
| JP | A-5-68760 | 3/1993 |
| JP | Y2-07-001114 | 1/1995 |
| JP | A-8-24464 | 1/1996 |
| JP | A-8-71287 | 3/1996 |
| JP | Y2-2503528 | 7/1996 |

(Continued)

OTHER PUBLICATIONS

U.S. Appl. No. 12/847,521, filed Jul. 30, 2010 in the name of Shinya Fujihara.

(Continued)

*Primary Examiner* — Ismael Izaguirre
(74) *Attorney, Agent, or Firm* — Oliff & Berridge, PLC

(57) ABSTRACT

A sewing machine includes a bed, a needle plate, an image capture device, an auxiliary optical member, a switching device, a command acquisition device, and a control device. The needle plate is provided on the bed and includes a needle hole. The image capture device is adapted to capture an image facing downward from above the needle hole. The auxiliary optical member is adapted to transmit light to an image capture device side of the auxiliary optical member. The switching device switches the auxiliary optical member to one of being used and not being used. The command acquisition device acquires a command. In a case where the command has been acquired, the control device controls the switching device to switch the auxiliary optical member to one of being used and not being used in accordance with the command.

7 Claims, 18 Drawing Sheets

FOREIGN PATENT DOCUMENTS

| | | |
|---|---|---|
| JP | A-09-250068 | 9/1997 |
| JP | A-11-172566 | 6/1999 |
| JP | A-2000-235212 | 8/2000 |
| JP | U-3100627 | 5/2004 |
| JP | A-2005-177777 | 7/2005 |
| JP | A-2006-012203 | 1/2006 |
| JP | A-2006-169696 | 6/2006 |
| JP | A-2007-289653 | 11/2007 |

OTHER PUBLICATIONS

Mar. 15, 2011 Office Action issued in Japanese Application No. 2009-069185 (with translation).
Office Action issued in Japanese Patent Application No. 2009-191576 dated Jun. 14, 2011 (with translation).
Aug. 23, 2012 Office Action issued in U.S. Appl. No. 12/847,521.

* cited by examiner

SEWING MACHINE AND COMPUTER-READABLE MEDIUM STORING SEWING MACHINE CONTROL PROGRAM

CROSS-REFERENCE TO RELATED APPLICATION

This application claims priority to Japanese Patent Application No. 2009-191580, filed Aug. 21, 2009, the content of which is hereby incorporated herein by reference in its entirety.

BACKGROUND

The present disclosure relates to a sewing machine that is provided with an image capture device and to a computer-readable medium that stores a sewing machine control program.

A sewing machine is known that is provided with an image capture device such as a camera or the like. For example, a sewing machine is known that uses an image capture device to capture an image of an area around a needle drop point and displays the captured image on an image display device. By looking at the image that is displayed on the image display device, a user can easily check the needle drop point and the state of the sewing without bringing user's face close to the area around the needle drop point.

SUMMARY

There are limits on the installation position and the installation space for the image capture device with which the sewing machine is provided, so the image capture device is generally compact. Therefore, in a case where the user wants to acquire an image that is captured by the image capture device with an auxiliary optical member such as a filter or the like attached to it, it is necessary for the user to attach the auxiliary optical member in an extremely limited space. Furthermore, in the sewing machine for which it is not assumed that the user attaches the auxiliary optical member the image capture device, an image that is captured using the auxiliary optical member cannot be acquired.

Various exemplary embodiments of the broad principles derived herein provide a sewing machine and a computer-readable medium that stores a sewing machine control program that are capable of switching easily between a configuration in which the image is captured using the auxiliary optical member and a configuration in which the image is captured without using the auxiliary optical member.

Exemplary embodiments provide a sewing machine that includes a bed, a needle plate, an image capture device, an auxiliary optical member, a switching device, a command acquisition device, and a control device. The needle plate is provided on the bed and includes a needle hole. The image capture device is adapted to capture an image facing downward from above the needle hole. The auxiliary optical member is adapted to transmit light to an image capture device side of the auxiliary optical member. The switching device switches the auxiliary optical member to one of being used and not being used. The command acquisition device acquires a command to switch the auxiliary optical member to one of being used and not being used. In a case where the command has been acquired by the command acquisition device, the control device controls the switching device to switch the auxiliary optical member to one of being used and not being used in accordance with the command.

Exemplary embodiments further provide a computer-readable medium storing a control program executable on a sewing machine that includes a bed, with a needle plate that is provided on the bed and includes a needle hole, and with an image capture device that is capable of capturing an image facing downward from above the needle hole. The program includes instructions that cause a controller of the sewing machine to perform the steps of acquiring a command to switch an auxiliary optical member that lets light pass through to an image capture device side of the auxiliary optical member to one of being used and not being used, and controlling, in a case where the command has been acquired, a switching device that switches the auxiliary optical member to one of being used and not being used to switch the auxiliary optical member to one of being used and not being used in accordance with the command.

BRIEF DESCRIPTION OF THE DRAWINGS

Exemplary embodiments will be described below in detail with reference to the accompanying drawings in which.

DETAILED DESCRIPTION

Hereinafter, sewing machines according to first and second embodiments of the present disclosure will be explained with reference to the drawings. The referenced drawings are used for explaining technical features that may be utilized in the present disclosure, and the device configurations and the like that are described are simply explanatory examples that do not limit the present disclosure to only those configurations and the like. In FIGS. 7, 11, 13, and 16, members such as needle bars 31 and the like that are disposed on an inner side of a frame 24 are omitted from the drawings.

A physical configuration of a multi-needle sewing machine 1 (hereinafter simply called the sewing machine 1) of a first embodiment will be explained with reference to FIGS. 1 to 3. In the explanation that follows, in FIG. 1, the lower left side, the upper right side, the upper left side, and the lower right side of the page respectively indicate the front side, the rear side, the left side, and the right side of the sewing machine 1.

Figure 1:
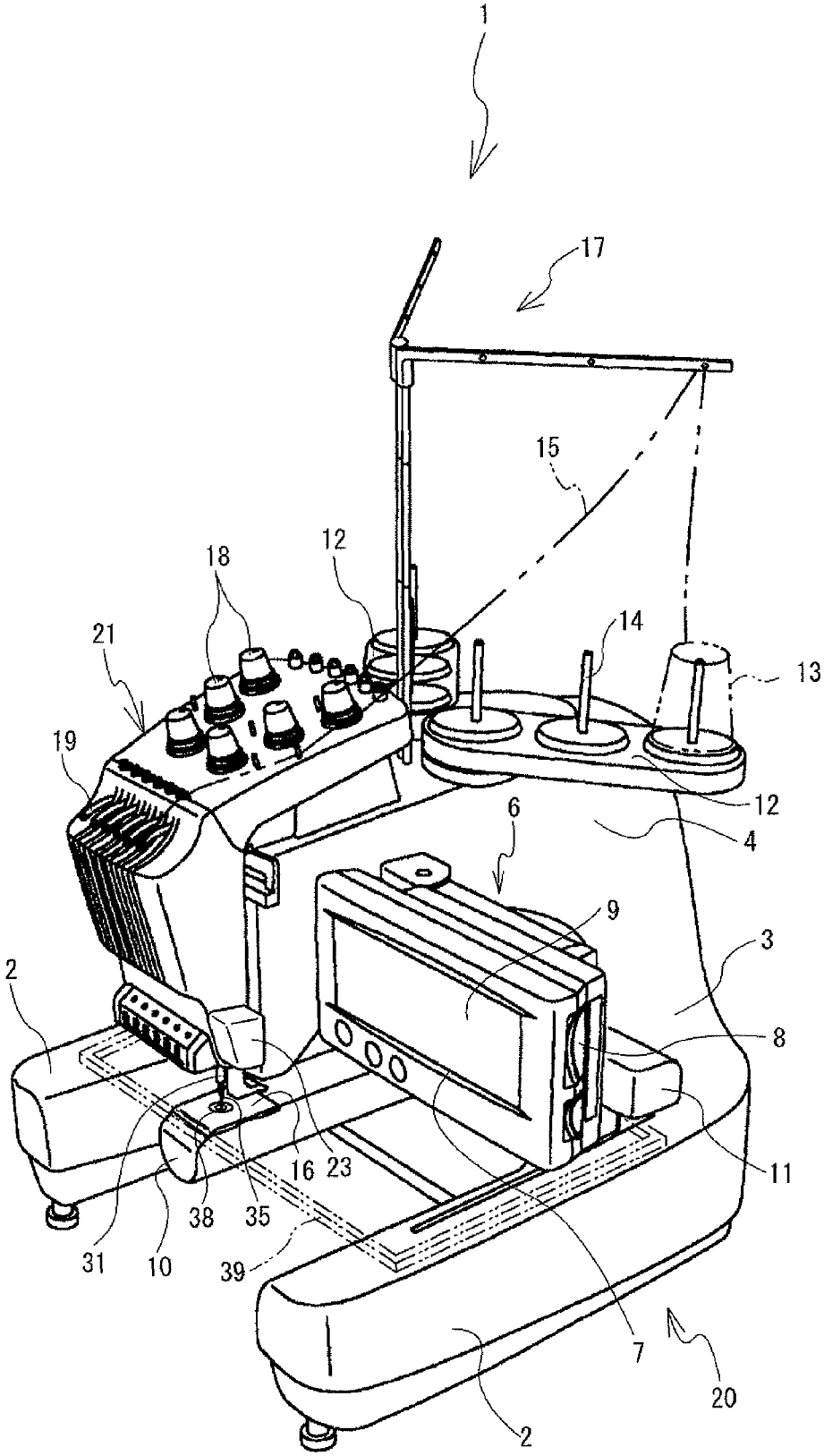
FIG. 1 is an oblique view of a multi-needle sewing machine.
Figure 2:
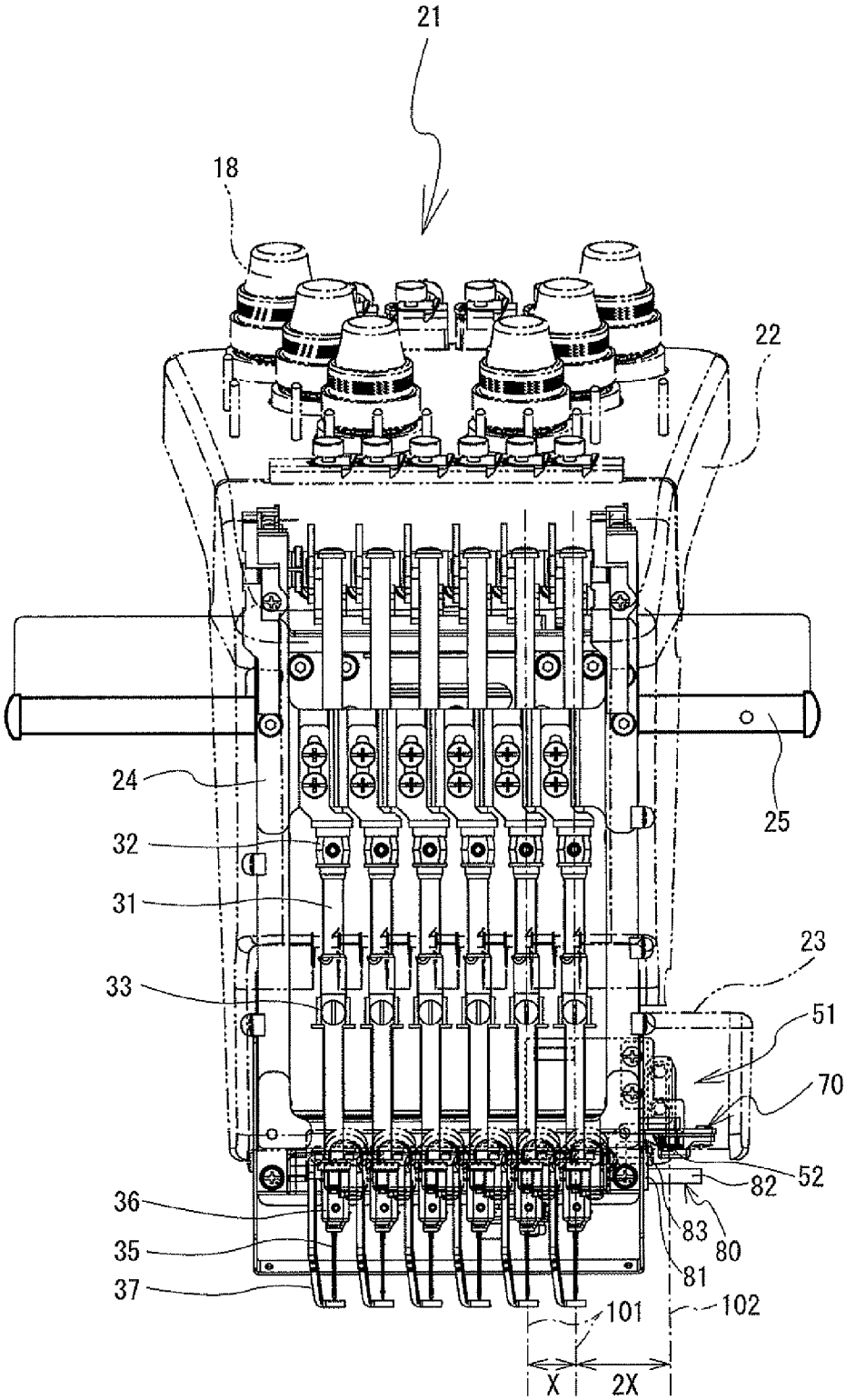
FIG. 2 is a transparent front view of a needle bar case.

As shown in FIGS. 1 and 2, the sewing machine 1 is a multi-needle sewing machine provided with six needle bars 31. A body 20 of the sewing machine 1 is provided with a supporting portion 2, a pillar 3, and an arm 4. The supporting portion 2 is formed in an inverted U shape in a plan view, and the supporting portion 2 supports the entire sewing machine 1. The pillar 3 is provided such that it rises upward from the rear portion of the supporting portion 2. The arm 4 extends forward from the upper end of the pillar 3. A needle bar case 21 is mounted on the front end of the arm 4 such that the needle bar case 21 can move to the left and to the right in relation to the body 20. The needle bar case 21 will be described in detail later.

An operation portion 6 is provided on the right side of the arm 4 at a central position in the front-to-rear direction. A vertically extending shaft (not shown in the drawings) serves as an axis of rotation on which the operation portion 6 is pivotally supported by the arm 4. The operation portion 6 includes a liquid crystal display (hereinafter simply called the LCD) 7, a touch panel 9, and a connector 8. An operation screen for a user to input commands, for example, may be displayed on the LCD 7. The touch panel 9 may be used to accept commands from the user. The user can select various types of conditions relating to a sewing pattern and sewing by using a finger, a stylus pen or the like to perform a pressing operation (the operation hereinafter being called a panel operation) on a location on the touch panel 9 that corresponds to a position on a screen that is displayed on the LCD 7 and that shows an input key or the like. The connector 8 can be connected to a memory card 160 (refer to FIG. 8).

A cylindrical cylinder bed 10 that extends forward from the bottom end of the pillar 3 is provided underneath the arm 4. A shuttle (not shown in the drawings) is provided in the interior of the front end of the cylinder bed 10. A bobbin (not shown in the drawings) on which a lower thread (not shown in the drawings) is wound may be accommodated in the shuttle. A shuttle drive mechanism (not shown in the drawings) is also provided in the interior of the cylinder bed 10. The shuttle drive mechanism rotationally drives the shuttle. A needle plate 16 that is rectangular in a plan view is provided on the front end of the top face of the cylinder bed 10. A needle hole 38 through which a needle 35 passes is provided in the needle plate 16. The needle drop point is the point where the needle 35 pierces the work cloth 39.

A Y carriage 11 of an embroidery frame moving mechanism (not shown in the drawings) that moves embroidery frame 39 to the left and the right, and forward and backward is provided underneath the arm 4. When an embroidery pattern is sewn, the embroidery frame 39 which holds the work cloth (not shown in the drawings) is set in an X carriage (not shown in the drawings) of the embroidery frame moving mechanism. The sewing machine 1 performs sewing of an embroidery pattern on a work cloth (not shown in the drawings) that is held by the embroidery frame 39 as the embroidery frame 39 is moved to the left and the right, and forward and backward, by an X axis motor 132 (refer to FIG. 8) and a Y axis motor 134 (refer to FIG. 8) of the embroidery frame moving mechanism.

A right-left pair of spool platforms 12 are provided at the rear face side of the top face of the arm 4. Three thread spool pins 14 are provided on each of the spool platforms 12. The thread spool pins 14 support thread spools 13. The number of the thread spools 13 that can be placed on the one pair of the spool platforms 12 is six, the same as the number of needle bars 31. Upper threads 15 are supplied from the thread spools 13 that are disposed on the spool platforms 12. Each of the upper threads 15 is supplied, through a thread guide 17, a tensioner 18, and a thread take-up lever 19, to an eye (not shown in the drawings) of each of the needles 35 that are attached to the bottom ends of the needle bars 31.

A drive shaft (not shown in the drawings) extends in the front-to-rear direction in the interior of the arm 4. The drive shaft is rotated by a sewing machine motor 122 (refer to FIG. 8). A needle bar drive mechanism (not shown in the drawings) for moving one of the six needle bars 31 up and down is provided on the front end of the drive shaft. The needle bar drive mechanism converts the rotational movement of the drive shaft into a cranking movement of a crank lever (not shown in the drawings) that moves a movable body (not shown in the drawings) reciprocally up and down. The movable body engages an engaging pin (not shown in the drawings) for one of the needle bars 31 that is centrally located in the right-to-left direction of the sewing machine 1, so that the movable body may move the one of the needle bars 31 up and down. The shuttle drive mechanism (not shown in the drawings) is driven in conjunction with the rotation of the drive shaft. When the drive shaft rotates, the one of the needle bars 31, the corresponding thread take-up lever 19, and the shuttle (not shown in the drawings) are driven in a synchronized manner, and a stitch may be formed on the work cloth (not shown in the drawings).

The needle bar case 21 will be explained with reference to FIGS. 2 and 3. In the explanation that follows, in FIG. 2, the front side, the rear side, the left side, and the right side of the page respectively indicate the front side, the rear side, the left side, and the right side of the sewing machine 1. In FIG. 3, the left side, the right side, the rear side, and front side of the page respectively indicate the front side, the rear side, the left side, and the right side of the sewing machine 1.

Figure 3:
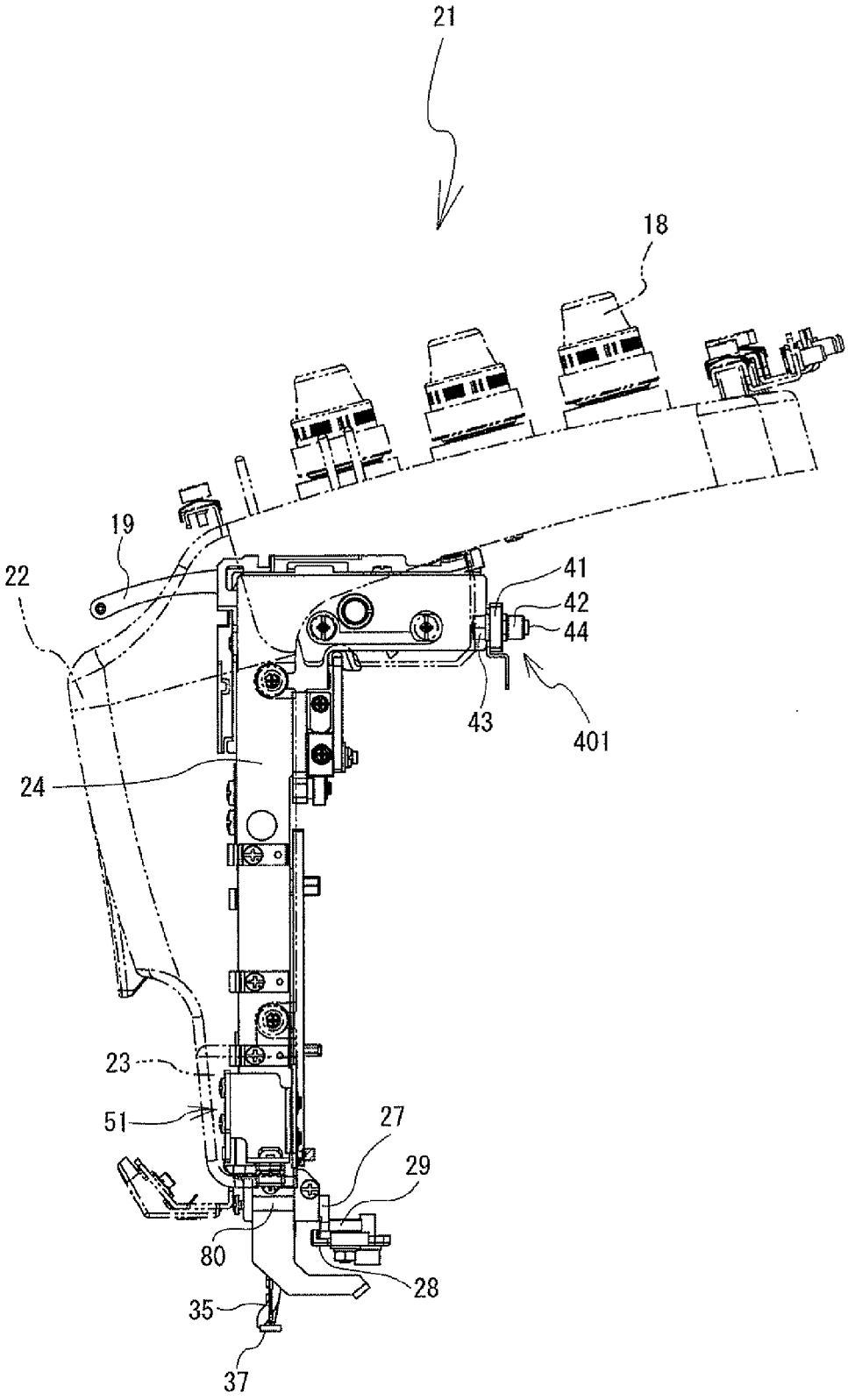
FIG. 3 is a transparent right side view of the needle bar case.

As shown in FIGS. 2 and 3, the frame 24 is provided in the interior of a cover 22 of the needle bar case 21. The frame 24 is rectangular when viewed from the front and has an inverted L shape when viewed from the right side. As shown in FIG. 2, a slide rail 25 that extends in the right-to-left direction is fixed to the front end portion of the arm 4 (refer to FIG. 1). The frame 24 is provided with a guide block (not shown in the drawings) slightly above the center point of the up-down direction. The guide block slides along the slide rail 25. As shown in FIG. 3, a restricting member 27 is fixed to the lower part of the rear face of the frame 24. The restricting member 27 restricts the movement of the frame 24 in the front-to-rear direction. A claw 28 and a plurality of rollers 29 are provided at the lower part of the front edge of the arm 4. The claw 28 engages the restricting member 27 on the frame 24. The plurality of the rollers 29 are in contact with the rear face of the restricting member 27. This configuration allows the frame 24 to smoothly move to the right and to the left in relation to the body 20 (refer to FIG. 1) while being guided by the slide rail 25.

Figure 4:
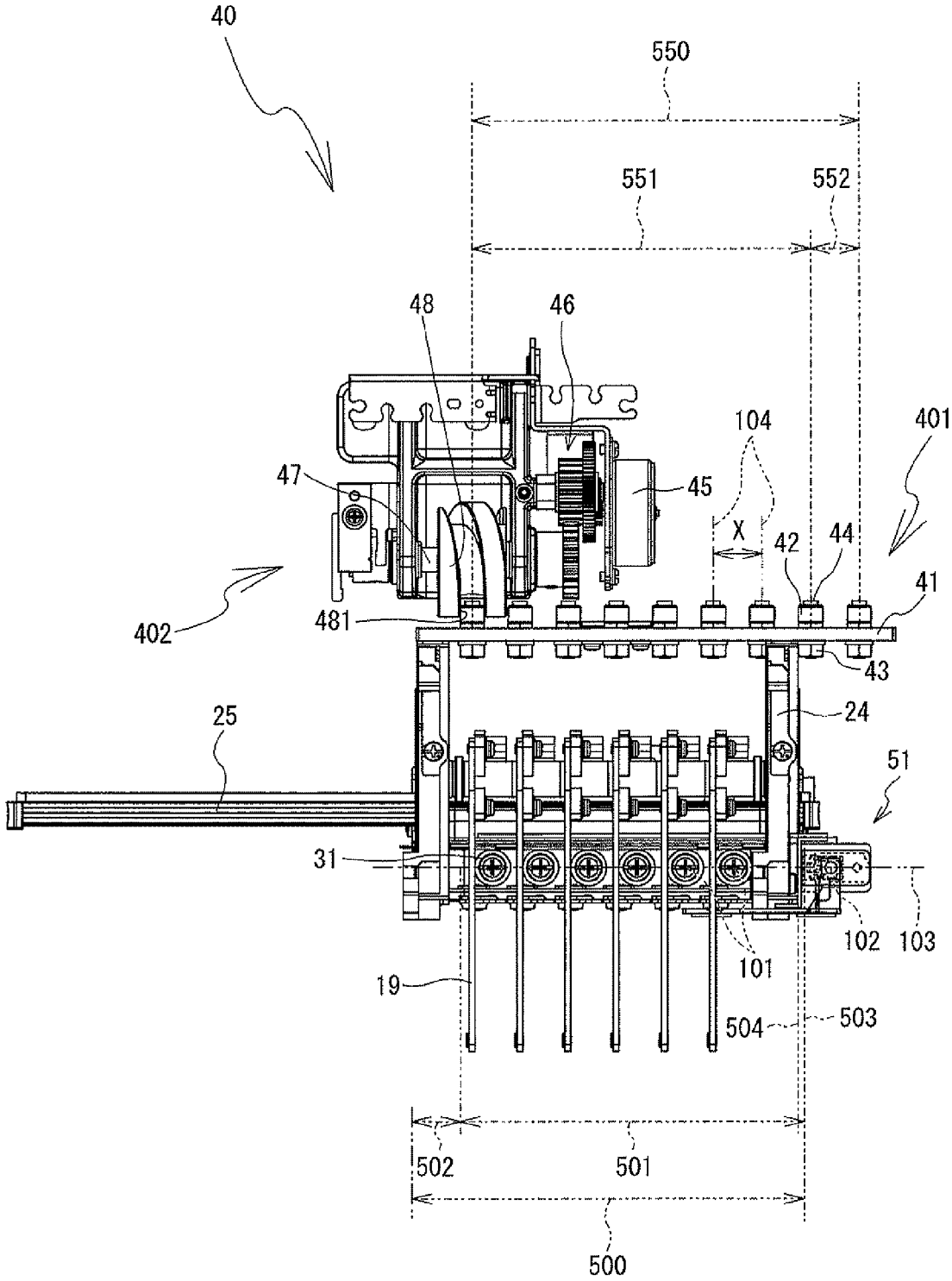
FIG. 4 is a plan view of a needle bar case moving mechanism in a state in which a frame has moved to a right end of a slide rail.

As shown in FIG. 2, the six needle bars 31 are lined up in the right-to-left direction inside the frame 24. A number from one to six is assigned to each of the six needle bars 31, starting from the right. Central axis lines 101 of the six needle bars 31 are each oriented in the vertical direction and are located in a single plane. In other words, in a plan view, as shown in FIG. 4, the central axis lines 101 of the six needle bars 31 are located on a single straight line 103. The intervals X between the central axis lines 101 of the needle bars 31 are all equal. Coil springs (not shown in the drawings) are mounted on the outsides of the needle bars 31, and the needle bars 31 are urged upward by the coil springs. The needle bars 31 are provided with needle bar holders 32 in the center of the up-down direction and are provided with presser holders 33 slightly below the center of the up-down direction. Needle holders 36 may each be fixed to the lower parts of the needle bars 31. The needles 35 may each be fixed to the needle holders 36. At this time, central axis lines of the needles 35 fixed to the needle holders 36 are aligned with the central axis lines 101 of the needle bars 31. Accordingly, the intervals between the central axis lines of the needles 35 are equal to the intervals X between the central axis lines of the needle bars 31. Presser feet 37 are extend from the presser holders 33 to slightly below the lower ends (the tips) of the needles 35. One of the presser feet 37 may move in conjunction with the up and down movement of one of the needles 35 and intermittently press the work cloth downward.

As shown in FIGS. 1 to 3, an image sensor holding mechanism 51 (hereinafter simply called the holding mechanism 51) is provided at the lower part of the right side face of the frame 24. The front face, the top face, and the right side face of the holding mechanism 51 are covered by a cover 23. The holding mechanism 51 holds an image sensor 52 above the cylinder bed 10, that is, higher than the needle hole 38, such that the position of the image sensor 52 in relation to the frame 24 can be changed. Details of the holding mechanism 51 and the optical member holding portion 80 will be described later.

At a position shown in FIG. 2, the distance between the central axis line 101 of the number one needle bar 31 and an optical axis 102 of the image sensor 52 is 2X, which is an integral multiple of the interval X between the needle bars 31. The number one needle bar 31 is the needle bar 31 that is the farthest to the right of the six needle bars 31. As shown in FIG. 4, in a plan view, the optical axis 102 of the image sensor 52 is located on the straight line 103 that passes through the central axis lines 101 of the six needle bars 31. The six needle bars 31 and the image sensor 52 are moved to the right and to the left in relation to the body 20 by moving the needle bar case 21 to the right and to the left.

A needle bar case moving mechanism 40 that moves the needle bar case 21 will be explained with reference to FIGS. 3 and 4. In FIG. 4, the lower side, the upper side, the left side, and the right side of the page respectively indicate the front side, the rear side, the left side, and the right side of the sewing machine 1.

As shown in FIG. 4, the needle bar case moving mechanism 40 is provided with an engaging roller portion 401 and a needle bar case drive portion 402. The engaging roller portion 401 is mounted on the frame 24. The engaging roller portion 401 includes a plate 41, engaging rollers 42, nuts 43, and shoulder screws 44. The plate 41 has a plate shape that is long in the left-right direction, and the plate 41 is attached to the rear edge of the upper portion of the frame 24, as shown in FIG. 3. As shown in FIG. 4, each of nine of the engaging rollers 42 is attached by one of the shoulder screws 44 to the rear face of the plate 41. Each of the engaging rollers 42 has a cylindrical shape, although this is not shown in detail in the drawings, and is supported by one of the shoulder screws 44 such that each of the engaging rollers 42 can rotate, but cannot move in the axial direction of the engaging roller 42. The shoulder screws 44 are inserted into holes in the plate 41 (not shown in the drawings) and are secured by the nuts 43. The intervals between the engaging rollers 42 (the intervals between central axis lines 104 of the engaging rollers 42) are all the same as the intervals X between the needle bars 31. The heights at which the nine engaging rollers 42 are attached are all the same.

The needle bar case drive portion 402 is located in the interior of the arm 4 (refer to FIG. 1), in a position that is to the rear of the plate 41. The needle bar case drive portion 402 includes a needle bar case motor 45, a gear portion 46, a rotating shaft 47, and a helical cam 48. The needle bar case motor 45 is a pulse motor. The needle bar case motor 45 is affixed such that the axial direction of an output shaft (not shown in the drawings) of the needle bar case motor 45 is oriented in the right-to-left direction. The needle bar case motor 45 transmits a driving force to the rotating shaft 47 via a gear portion 46, thus rotating the helical cam 48 by a specified amount. The rotating shaft 47 is supported in parallel with the output shaft of the needle bar case motor 45. The helical cam 48 is secured to the outer circumference of the rotating shaft 47 and is at all times engaged with one of the nine engaging rollers 42. The helical cam 48 includes a positioning portion 481. In a case where the rotation of the rotating shaft 47 has been stopped, one of the nine engaging rollers 42 is engaged with the positioning portion 481 of the helical cam 48. The positioning portion 481 is shaped such that the position of the engaging roller 42 that is engaged with the helical cam 48 does not change, even in a case where the rotating shaft 47 has been rotated to a specified angle. The positional relationship between the helical cam 48 and the engaging roller 42 that engages the helical cam 48 remains the same, no matter which of the engaging rollers 42 engages the positioning portion 481 of the helical cam 48.

In a case where the engaging roller 42 that is disposed the farthest to the left is engaged with the positioning portion 481 of the helical cam 48, as shown in FIG. 4, the needle bar 31 with the needle bar number six is disposed directly above the needle hole 38 (refer to FIG. 1). In a case where the engaging roller 42 that is the second from the left is engaged with the positioning portion 481 of the helical cam 48, the needle bar 31 with the needle bar number five is disposed directly above the needle hole 38. The same sort of relationships exist between the rest of the engaging rollers 42 and the needle bars 31. As will be described in detail later, in a case where one of the first and the second of the engaging rollers 42 from the right is engaged with the positioning portion 481 of the helical cam 48, the image sensor 52 is disposed directly above the needle hole 38. In the explanation that follows, a case where one of the engaging rollers 42 that is disposed from the first to the sixth from the left is engaged with the positioning portion 481 of the helical cam 48 is called a case in which the needle bar case 21 is in a sewing position. A case where one of the first and the second of the engaging rollers 42 from the right is engaged with the positioning portion 481 of the helical cam 48 is called a case in which the needle bar case 21 is in an image capture position.

The operation of moving the needle bar case 21 will be explained with reference to FIG. 4. The needle bar case 21 is moved by the needle bar case moving mechanism 40 in the left-right direction (the horizontal direction) in relation to the body 20. Every time the helical cam 48 rotates 360 degrees, the needle bar case moving mechanism 40 can move the needle bar case 21 by the distance X along the left-light direction. The direction in which the needle bar case 21 moves is determined according to the direction of the rotation of the helical cam 48. In a case where the helical cam 48 rotates counterclockwise as seen from the right side, the needle bar case 21 moves to the left. In a case where the helical cam 48 rotates clockwise as seen from the right side, the needle bar case 21 moves to the right.

Specifically, when the helical cam 48, starting from the state that is shown in FIG. 4, rotates counterclockwise as seen from the right side, the engaging roller 42 that is the farthest to the left slides leftward in relation to the helical cam 48, and the frame 24 starts moving to the left in relation to the body 20 (refer to FIG. 1). Next, the engagement between the helical cam 48 and the engaging roller 42 that is the farthest to the left is released, and the engaging roller 42 that is the second from the left engages the helical cam 48. In the state that is shown in FIG. 4, when the helical cam 48 makes one rotation counterclockwise as seen from the right side, the needle bar 31 that is the second from the left (the needle bar 31 with the needle bar number five) is accurately disposed directly above the needle hole 38. In other words, the frame 24 moves to the left from the position that is shown in FIG. 4 by the distance X. In contrast, when the helical cam 48 makes one rotation clockwise as seen from the right side, the frame 24 moves to the right in relation to the body 20 by the distance X. In this manner, every time the helical cam 48 makes one rotation, the needle bar case moving mechanism 40 can move the needle bar case 21 to one of the left and the right by the distance X, according to the direction of the rotation of the helical cam 48.

The possible range of movement of the needle bar case 21 is defined by the slide rail 25 and the engaging rollers 42. In FIG. 4, the possible range of movement of the needle bar case 21 is graphically indicated by a movable range 500 of a right edge 504 of the frame 24, using a right end 503 of the slide rail 25 as a reference point. A holding range 501 and a switching range 502 are included in the movable range 500. The holding range 501 is a range in which the positional relationship between the needle bar case 21 and the image sensor 52 is kept fixed while the needle bar case 21 is moved (a range in which the needle bar case 21 and the image sensor 52 move as a single unit). The switching range 502 is a range in which the positional relationship between the needle bar case 21 and the image sensor 52 changes while the needle bar case 21 is moved. A range 550 that extends from the central axis line 104 of the engaging roller 42 that is the farthest to the left to the central axis line 104 of the engaging roller 42 that is the farthest to the right is also shown in FIG. 4. A range 551 and a range 552 are included in the range 550. The range 551 is a range that corresponds to the holding range 501, and the range 551 indicates a range that includes the central axis lines 104 of the engaging rollers 42 that engage the positioning portion 481 of the helical cam 48 while the needle bar case 21 is within the holding range 501. Specifically, the central axis lines 104 of the first to the eighth of the engaging rollers 42 are included in the range 551. The range 552 is a range that corresponds to the switching range 502, and the range 552 indicates a range that includes central axis line 104 of the engaging roller 42 that engages the positioning portion 481 of the helical cam 48 while the needle bar case 21 is within the switching range 502. Specifically, the central axis line 104 of the engaging roller 42 that is the farthest to the right is included in the range 552. As described previously, in the sewing machine 1 according to the first embodiment, in a case where the rotation of the rotating shaft 47 has been stopped, one of the engaging rollers 42 is engaged with the positioning portion 481 of the helical cam 48. To put it differently, in a case where the needle bar case 21 has been stopped, the needle bar case 21 is in one of nine positions, depending on which of the engaging rollers 42 is engaged with the positioning portion 481 of the helical cam 48.

Figure 6:
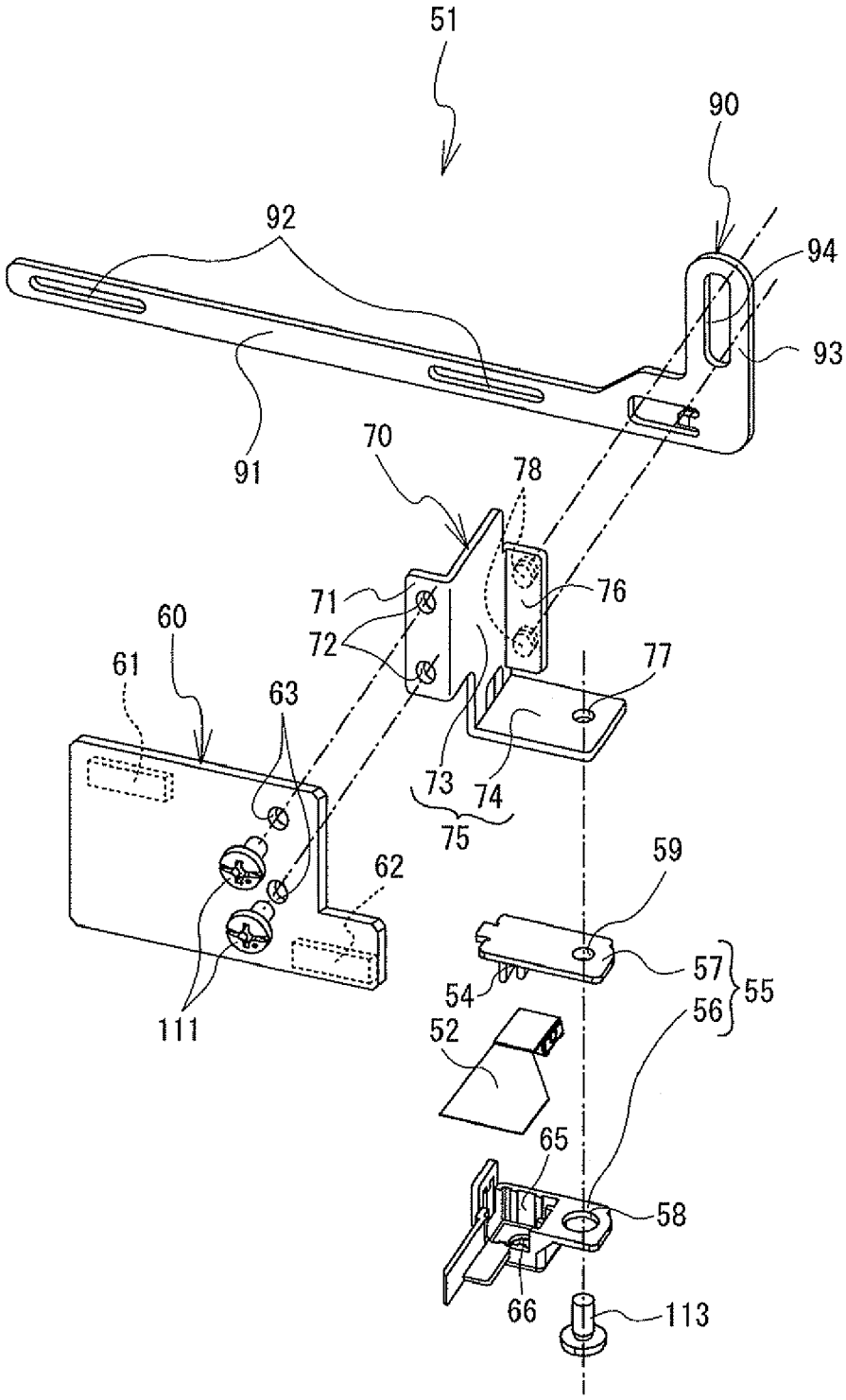
FIG. 6 is an oblique exploded view of the image sensor holding mechanism.
Figure 7:
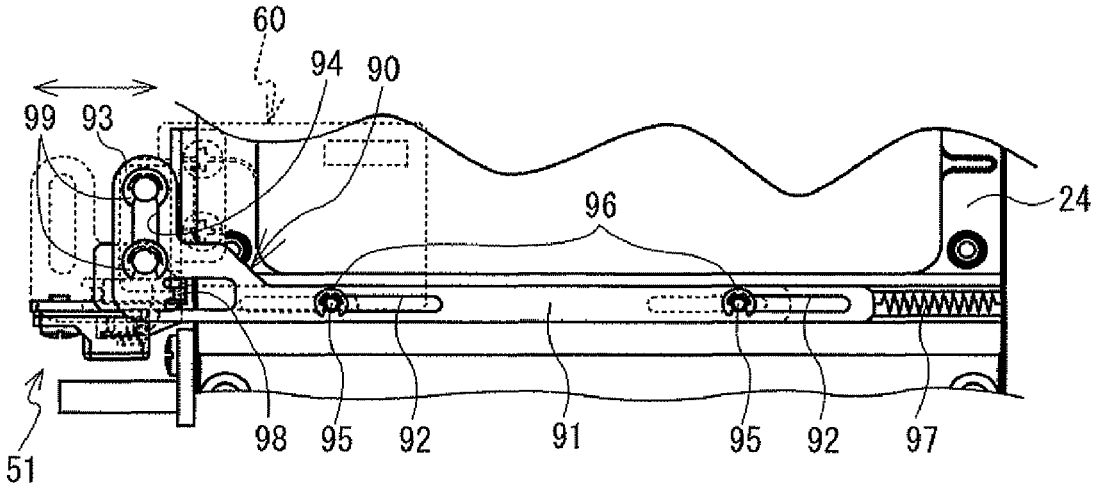
FIG. 7 is a rear side view of the image sensor holding mechanism.

The holding mechanism 51 will be explained with reference to FIGS. 2 to 7. In the explanation that follows, in FIG. 6, the lower left side, the upper right side, the upper left side, and the lower right side of the page respectively indicate the front side, the rear side, the left side, and the right side of the sewing machine 1. In FIG. 7, the left side, the right side, the front side, and the rear side of the page respectively indicate the right side, the left side, the rear side, and the front side of the sewing machine 1.

Figure 5:
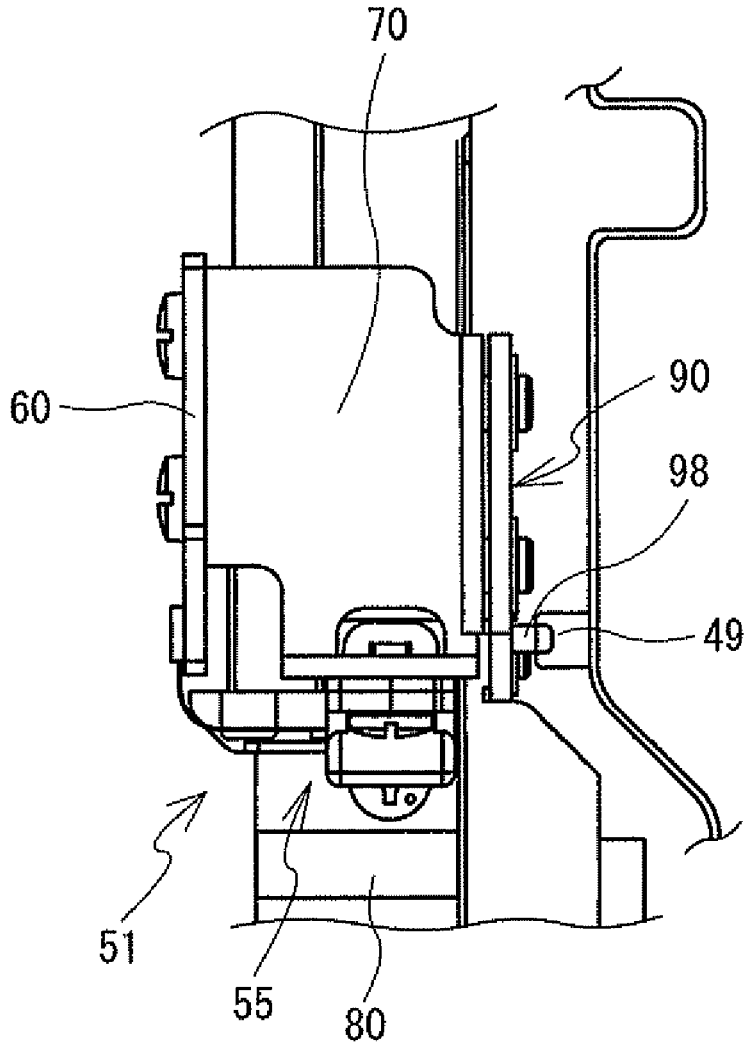
FIG. 5 is a right side view of an image sensor holding mechanism.

As shown in FIGS. 2 to 5, the holding mechanism 51 is attached to the lower portion of the right side face of the frame 24. The holding mechanism 51 supports the image sensor 52 such that the image sensor 52 can move in the left-right direction (the horizontal direction) in relation to the needle bar case 21. As shown in FIGS. 5 and 6, the holding mechanism 51 includes the image sensor 52, a sensor holder 55, a connecting plate 60, a sensor base plate 70, and a guide plate 90. The various members with which the holding mechanism 51 is provided will be described in detail below.

The image sensor 52 is a known complementary metal oxide semiconductor (CMOS) image sensor. In a case where the needle bar case 21 has been moved to the image capture position, the image sensor 52 is disposed directly above the needle hole 38. As shown in FIG. 6, the sensor holder 55 is includes a sensor support portion 56 and a sensor cover 57 that is made of plastic. A box-shaped recessed portion 65 is provided in the left portion of the sensor support portion 56. A circular opening 66 is provided in the bottom face of the recessed portion 65. A hole 58, into which a screw 113 is inserted, is provided in the right portion of the sensor support portion 56. The sensor cover 57 is a plate-shaped member that is rectangular in a plan view, and the sensor cover 57 is provided with a projecting portion 54 on its bottom face. A screw hole 59, into which the screw 113 is inserted, is provided in the right portion of the sensor cover 57. The image sensor 52 is inserted into the recessed portion 65 of the sensor support portion 56 such that a lens (not shown in the drawings) faces the opening 66 side (downward) and the image sensor 52 is held between the sensor support portion 56 and the sensor cover 57. The projecting portion 54 that is provided on the bottom face of the sensor cover 57 functions as a plastic spring that lightly presses upon the image sensor 52 from above, thus holding the image sensor 52 in place.

The connecting plate 60 is a plate that has an L shape when viewed from the front, and the connecting plate 60 electrically connects the image sensor 52 and a control portion 140 (refer to FIG. 8) of the sewing machine 1. The connecting plate 60 is provided with the connector 62 that is electrically connected to the image sensor 52 and with a connector 61 that is electrically connected to the control portion 140 of the sewing machine 1. Two screw holes 63 are provided in the right portion of the connecting plate 60, one above the other.

The sensor base plate 70 supports the connecting plate 60 and the sensor holder 55, respectively. The sensor base plate 70 is supported by the guide plate 90 such that the sensor base plate 70 can move in the left-right direction in relation to the needle bar case 21. The sensor base plate 70 includes a plate connecting portion 71, a sensor connecting portion 75, and a guide plate connecting portion 76. The plate connecting portion 71 has a rectangular shape in a front view. Two screw holes 72 are provided in the plate connecting portion 71, one above the other. The connecting plate 60 is secured to the plate connecting portion 71 by screws 111 that are inserted into the screw holes 63 in the connecting plate 60 and the screw holes 72 in the plate connecting portion 71. In a front view, the sensor connecting portion 75 has an L shape that may be formed by bending a rectangular plate of a specified thickness at a right angle. The sensor connecting portion 75 includes a face 73 and a face 74. The face 73 extends at a right angle to the rear from the right edge portion of the plate connecting portion 71. The face 74 extends at a right angle to the right from the bottom edge of the face 73. The length of the sensor connecting portion 75 in the up-down direction is greater than the length of the plate connecting portion 71 in the up-down direction, and the upper edges of the sensor connecting portion 75 and the plate connecting portion 71 are both at the same height. A screw hole 77 is provided in the right portion of the face 74. The sensor holder 55 is secured to the bottom face of the sensor base plate 70 by the screw 113 that is inserted into the hole 58 and the screw hole 59 of the sensor holder 55 and into the screw hole 77 of the sensor connecting portion 75. The cover 23 is secured to the face 73 by an attaching portion (not shown in the drawings). The guide plate connecting portion 76 extends at a right angle to the right from a vertically central portion of the rear edge of the face 73. Two pins 78 are provided on the rear face of the guide plate connecting portion 76, one above the other. The pins 78 are cylindrical, and they are inserted into a guide hole 94 of the guide plate 90, which is described below, the rear ends of the pins 78 being secured by retaining rings 99 (refer to FIG. 7).

The guide plate 90 is L-shaped in a front view, and the guide plate 90 includes a plate-shaped slide portion 91 that is long in the left-right direction and a plate-shaped support portion 93 that is long in the up-down direction. Two guide holes 92 are provided in the slide portion 91 in the left-right direction. The guide holes 92 are elongated holes that are long in the left-right direction. The lengths of the guide holes 92 in the left-right direction are determined according to the range within which the guide plate 90 slides in relation to the frame 24. As shown in FIG. 7, positioning pins 95 that are press fitted into the frame 24 are inserted into the guide holes 92. The rear ends of the positioning pins 95 that are inserted into the guide holes 92 are secured by retaining rings 96. The guide plate 90 is supported on the frame 24 by the positioning pins 95 such that the guide plate 90 can slide in the left-right direction (the horizontal direction) in relation to the frame 24. One end of a spring 97 is attached to the left end of the slide portion 91. The other end of the spring 97 is secured to the frame 24, and the guide plate 90 is urged by the spring 97 toward the left side of the sewing machine 1. The guide hole 94 is located in the support portion 93, with its long dimension running in the up-down direction. The pins 78 of the sensor base plate 70 are inserted into the guide hole 94, and the ends of the pins 78 are secured by the retaining rings 99. A projecting portion 98 that projects toward the arm 4 is provided in the lower portion of the rear face of the support portion 93. In a case where the needle bar case 21 has been moved to a contact position, the projecting portion 98 is in contact with a projecting portion 49 that is provided in the interior of the arm 4 (refer to FIG. 5). The contact position is the position where the engaging roller 42 that is the second from the right engages the positioning portion 481 of the helical cam 48.

The optical member holding portion 80 will be explained with reference to FIG. 2. The sewing machine 1 is provided with an auxiliary optical member that is disposed in an optical path of the image sensor 52 in accordance with a command from the user. What is here called the optical path includes a course that light follows from an object whose image is captured to the image sensor 52. The optical member holding portion 80 includes a support portion 81, a filter 82, and a screw 83. The filter 82 includes a polarizing filter as the auxiliary optical member. The support portion 81 supports the filter 82 on the right side face of the frame 24 and is provided with a screw hole (not shown in the drawings) into which the screw 83 is inserted. The optical member holding portion 80 is secured by the screw 83 to the right side face of the frame 24 below the holding mechanism 51.

Figure 8:
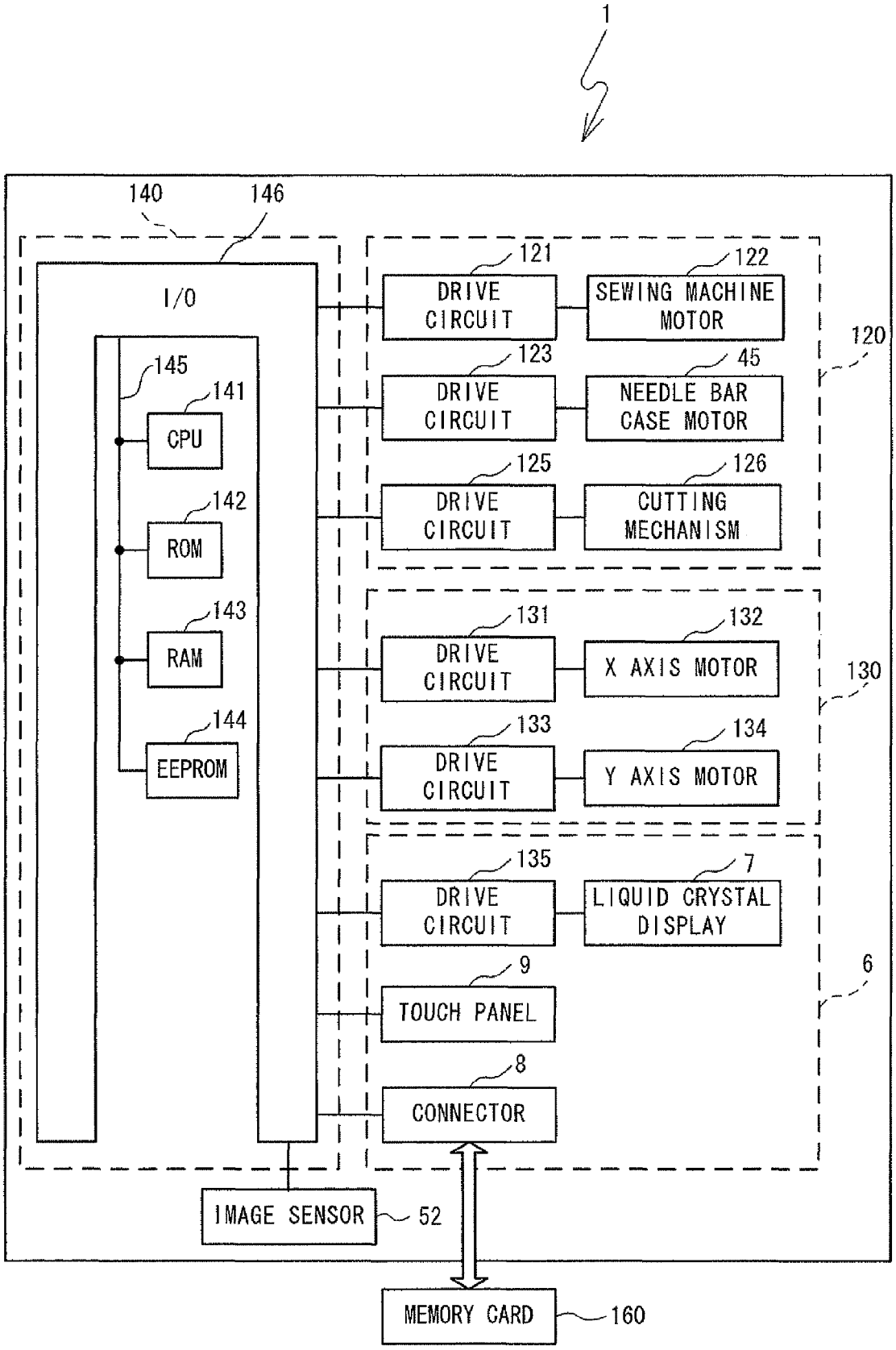
FIG. 8 is a block diagram that shows an electrical configuration of the multi-needle sewing machine.

Next, the electrical configuration of the sewing machine 1 will be explained with reference to FIG. 8. As shown in FIG. 8, the sewing machine 1 includes a needle drive portion 120, a sewn object drive portion 130, the operation portion 6, the image sensor 52, and the control portion 140. The needle drive portion 120, the sewn object drive portion 130, the operation portion 6, and the control portion 140 will each be described in detail below.

The needle drive portion 120 includes the sewing machine motor 122, a drive circuit 121, the needle bar case motor 45, a drive circuit 123, a cutting mechanism 126, and a drive circuit 125. The sewing machine motor 122 moves the needle bars 31 reciprocally up and down. The drive circuit 121 drives the sewing machine 122 in accordance with a control signal from the control portion 140. The needle bar case motor 45 moves the needle bar case 21 to the left and to the right in relation to the body 20 of the sewing machine 1. The drive circuit 123 drives the needle bar case motor 45 in accordance with a control signal from the control portion 140. The cutting mechanism 126 cuts the upper threads 15 (refer to FIG. 1) that are supplied to the needles 35 (refer to FIGS. 2 and 3). The drive circuit 125 drives the cutting mechanism 126 in accordance with a control signal from the control portion 140.

The sewn object drive portion 130 includes the X axis motor 132, a drive circuit 131, the Y axis motor 134, and a drive circuit 133. The X axis motor 132 moves the embroidery frame 39 (refer to FIG. 1) to the left and to the right. The drive circuit 131 drives the X axis motor 132 in accordance with a control signal from the control portion 140. The Y axis motor 134 moves the embroidery frame 39 forward and backward. The drive circuit 133 drives the Y axis motor 134 in accordance with a control signal from the control portion 140.

The operation portion 6 includes the touch panel 9, the connector 8, a drive circuit 135, and the LCD 7. The drive circuit 135 drives the LCD 7 in accordance with a control signal from the control portion 140. The connector 8 can connect to the memory card 160.

The control portion 140 includes a CPU 141, a ROM 142, a RAM 143, an EEPROM 144, and an input/output interface (I/O) 146, all of which are connected to one another by a bus 145. The needle drive portion 120, the sewn object drive portion 130, the operation portion 6, and the image sensor 52 are each connected to the I/O 146. The CPU 141, the ROM 142, the RAM 143, and the EEPROM 144 will be explained in detail below.

The CPU 141 performs main control over the sewing machine 1 and, in accordance with various types of programs that are stored in a program storage area (not shown in the drawings) in the ROM 142, performs various types of computations and processing that relating to sewing. The programs may also be stored in an external storage device such as a flexible disk or the like.

The ROM 142 includes a plurality of storage areas that include the program storage area, although these are not shown in the drawings. Various types of programs for operating the sewing machine 1, including an embroidery program and an image capture program, are stored in the program storage area. The embroidery program is a program for sewing the embroidery pattern on the work cloth (not shown in the drawings) that is held by the embroidery frame 39, in accordance with embroidery data. The image capture program is a program for capturing an image using the image sensor 52. The RAM 143 is a storage element that can be read from and written to as desired, and storage areas that store computation results and the like from computational processing by the CPU 141 are provided in the RAM 143 as necessary. The EEPROM 144 is a storage element that can be read from and written to as desired, and various types of parameters for the sewing machine 1 to perform various types of processing are stored in the EEPROM 144.

Figure 9:
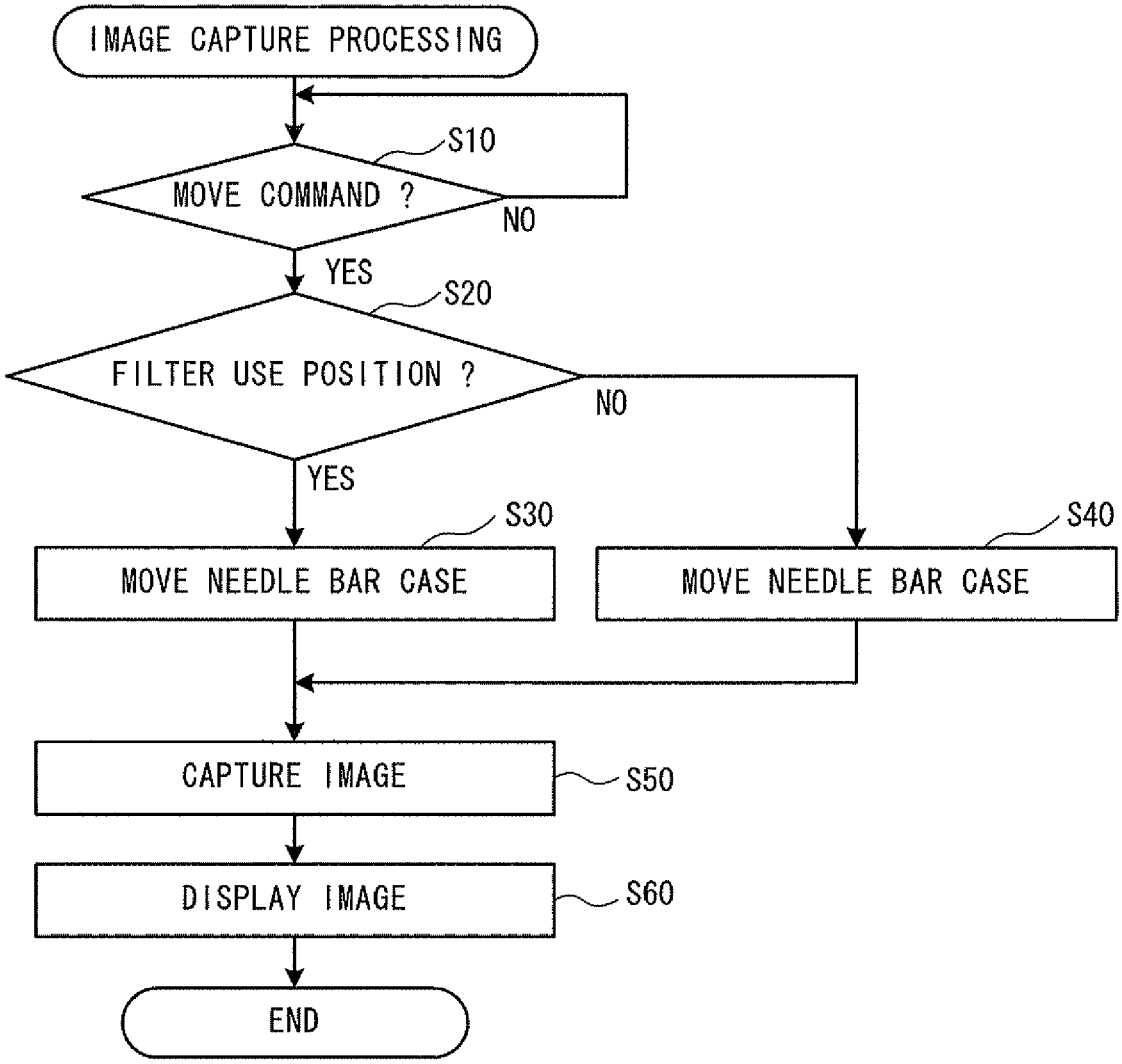
FIG. 9 is a flowchart of image capture processing.

Image capture processing according to the first embodiment will be explained with reference to FIGS. 9 to 15. In the image capture processing, the sewing machine 1 according to the first embodiment displays on the LCD 7 an image that is represented by image data that have been generated by the image sensor 52. The image capture processing that is shown in FIG. 9 is started in a case where a start command has been input. The start command may be input by the panel operation, for example. The image capture processing that is shown in FIG. 9 is performed by the CPU 141 that is shown in FIG. 8, in accordance with the image capture program that is stored in the ROM 142 that is shown in FIG. 8. In order to simplify the explanation, it will be assumed that in the image capture processing in each of the first to third embodiment, the needle bar case 21 is in the sewing position when the image capture processing starts.

First an outline of the image capture processing of the first embodiment will be explained. The sewing machine 1 according to the first embodiment positions the image sensor 52 directly above the needle hole 38 (refer to FIG. 1) and acquires the image. The sewing machine 1 according to the first embodiment is adapted to capture the image of the needle drop point from one of two image capture positions (a filter use position and a filter nonuse position) in which the positional relationships between the image sensor 52 and the filter 82 are different. The filter use position (a first position) is a position in which the filter 82 is disposed in the optical path of the image sensor 52. The filter nonuse position (a second position) is a position in which the filter 82 is out of the optical path of the image sensor 52. In a case where the image capture position is set to the filter use position (the first position), the sewing machine 1 moves the needle bar case 21 to the position where the engaging roller 42 that is the second from the right engages the positioning portion 481 of the helical cam 48. In a case where the image capture position is set to the filter nonuse position (the second position), the sewing machine 1 moves the needle bar case 21 to the position where the engaging roller 42 that is the farthest to the right engages the positioning portion 481 of the helical cam 48. The image capture position is selected by the user and is input by the panel operation along with a move command. The move command is a command that moves the image sensor 52 to the image capture position.

The image capture processing in FIG. 9 will be explained in more detail. As shown in FIG. 9, in the image capture processing, first, a determination is made as to whether the move command has been acquired (Step S10). In a case where the move command has been acquired (YES at Step S10), a determination is made as to whether the image capture position that is specified by the move command that has acquired at Step S10 is the filter use position (the first position) (Step S20).

Figure 10:
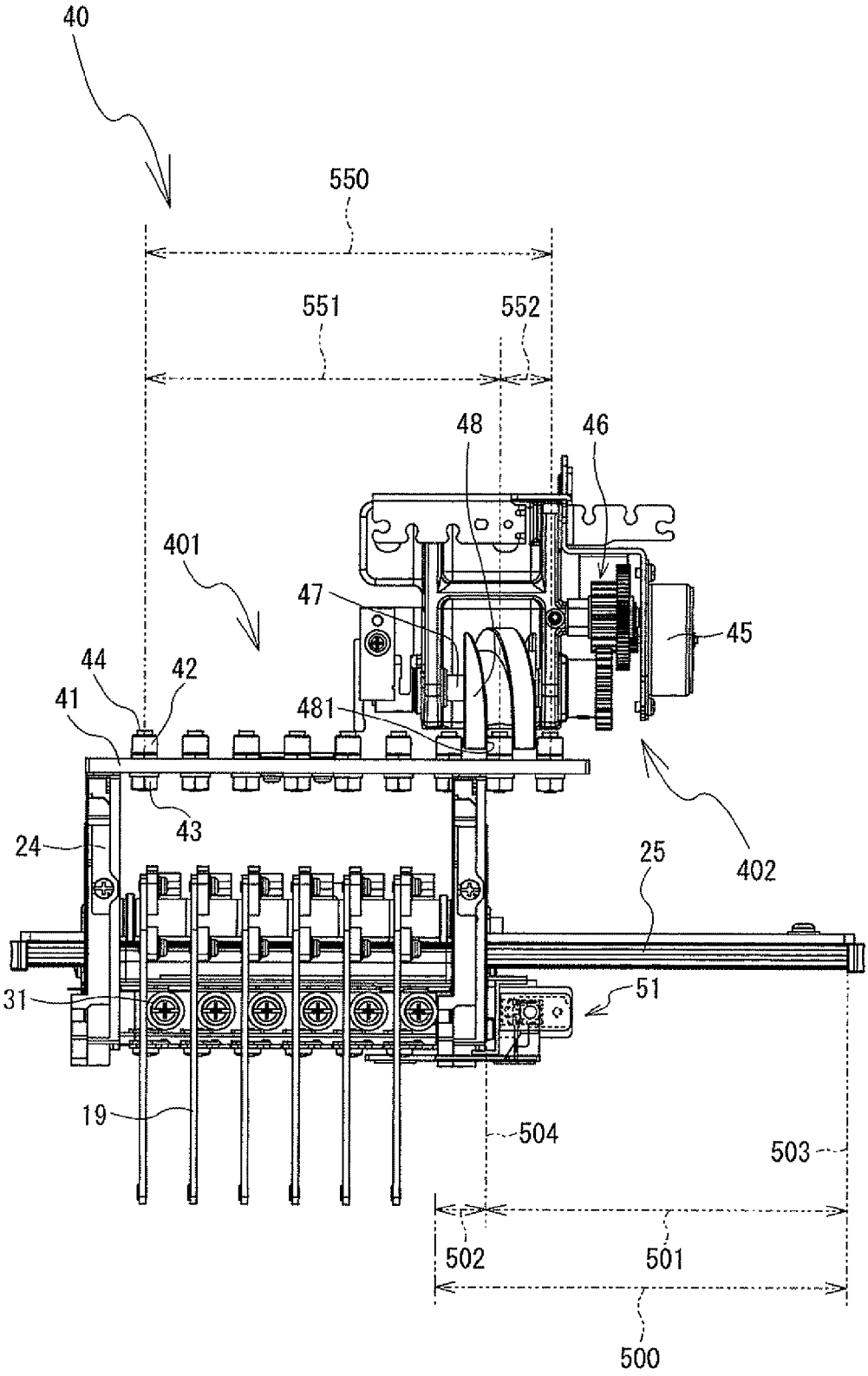
FIG. 10 is a plan view of the needle bar case moving mechanism in a case where an engaging roller that is second from the right is engaged with the positioning portion of the helical cam.
Figure 11:
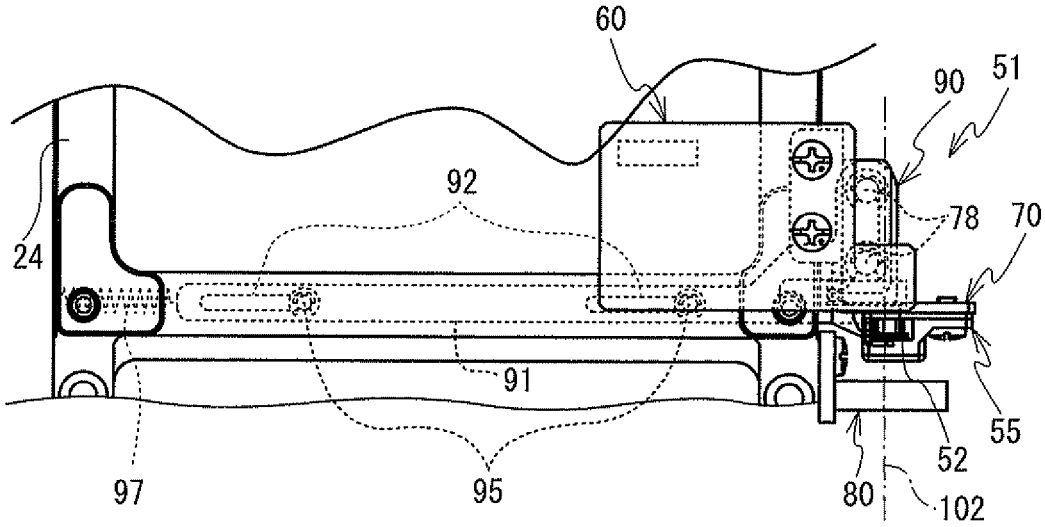
FIG. 11 is a front view of an image sensor holding mechanism in a case where the needle bar case is in the position in FIG. 10.
Figure 12:
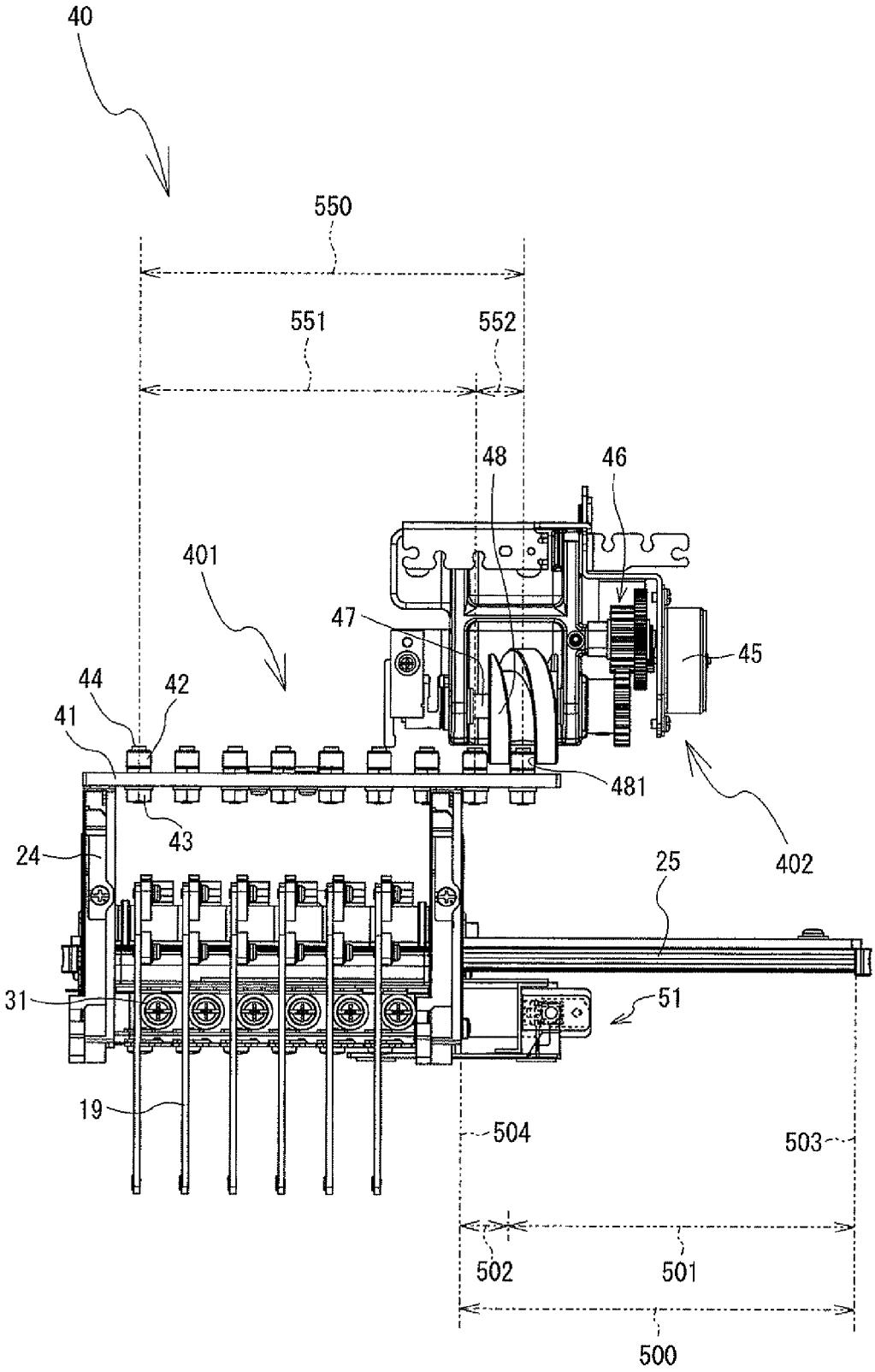
FIG. 12 is a plan view of the needle bar case moving mechanism in a case where a rightmost engaging roller is engaged with the positioning portion of the helical cam.
Figure 13:
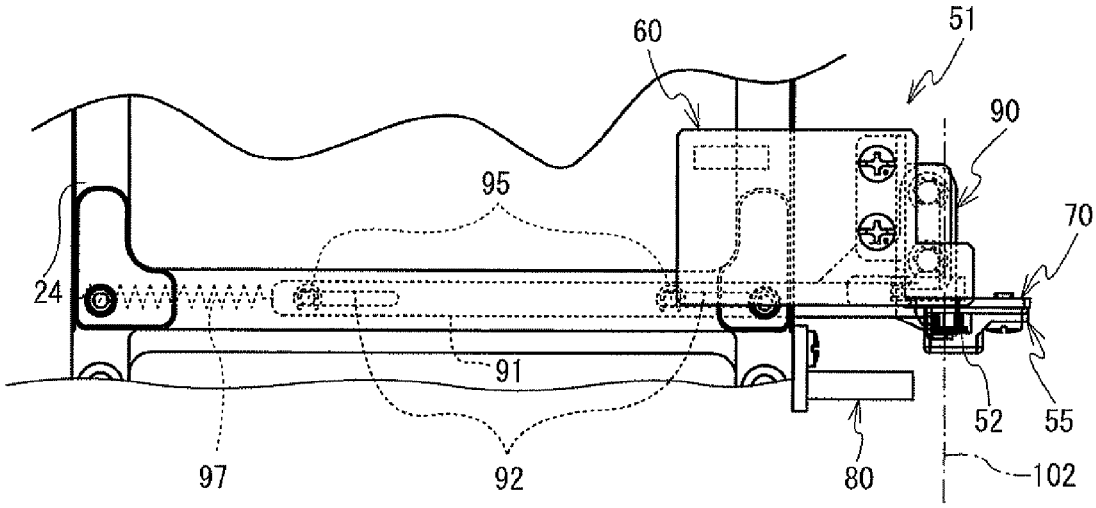
FIG. 13 is a front view of the image sensor holding mechanism in a case where the needle bar case is in the position in FIG. 12.

In a case where the specified image capture position is the filter use position (YES at Step S20), the needle bar case 21 is moved to the position that is shown in FIG. 10 (hereinafter simply called the position in FIG. 10), where the engaging roller 42 that is the second from the right engages the positioning portion 481 of the helical cam 48 (Step S30). More specifically, a control signal is output to the drive circuit 123 (refer to FIG. 8), and the needle bar case motor 45 is driven such that the position of the needle bar case 21 (the frame 24) in relation to the body 20 becomes the position in FIG. 10. The position in FIG. 10 is the contact position. At the position in FIG. 10, the right edge 504 of the frame 24 is on the boundary between the holding range 501 and the switching range 502. At the position in FIG. 10, the image sensor 52 is disposed above the needle hole 38. In a case where the needle bar case 21 is at the position in FIG. 10, the positioning pins 95 are at the right ends of the guide holes 92 in the guide plate 90, as shown in FIG. 11. In the case where the needle bar case 21 is at the position in FIG. 10, the image sensor 52 is at the filter use position. At the filter use position, the filter 82 is disposed in the optical path of the image sensor 52. In contrast, in a case where the specified image capture position is the filter nonuse position (the second position) (NO at Step S20), the needle bar case 21 is moved to the position that is shown in FIG. 12 (hereinafter simply called the position in FIG. 12), where the engaging roller 42 that is the farthest to the right engages the positioning portion 481 of the helical cam 48 (Step S40). More specifically, a control signal is output to the drive circuit 123, and the needle bar case motor 45 is driven such that the position of the needle bar case 21 (the frame 24) becomes the position in FIG. 12. At the position in FIG. 12, the right edge 504 of the frame 24 is within the switching range 502. At the position in FIG. 12, the image sensor 52 is disposed above the needle hole 38. In a case where the needle bar case 21 is at the position in FIG. 12, the positioning pins 95 are at the left ends of the guide holes 92 in the guide plate 90, as shown in FIG. 13. In the case where the needle bar case 21 is at the position in FIG. 12, the image sensor 52 is at the filter nonuse position. At the filter nonuse position, the filter 82 has been moved out of the optical path of the image sensor 52.

The operation of the holding mechanism 51 at Step S40 will be explained. In a case where the needle bar case 21 is at the position in FIG. 10 (the contact position), the projecting portion 98 of the guide plate 90 is in contact with the projecting portion 49 that is provided in the interior of the arm 4 (refer to FIG. 5). When the needle bar case 21 is moved farther into a range in which the right edge 504 of the frame 24 is within the switching range 502, the movement of the guide plate 90 in the direction in which the needle bar case 21 is moved is restricted by the projecting portion 49, such that the guide plate 90 slides to the right (in the horizontal direction) in relation to the needle bar case 21. In contrast, the optical member holding portion 80 is secured to the right side face of the frame 24, so it moves together with the needle bar case 21, even when the needle bar case 21 is moved farther into the range in which the right edge 504 of the frame 24 is within the switching range 502. Therefore, the moving of the needle bar case 21 to the position in FIG. 12 switches the positional relationship between the filter 82 and the image sensor 52 in relation to the positional relationship between the filter 82 and the image sensor 52 before the needle bar case 21 was moved.

Figure 14:
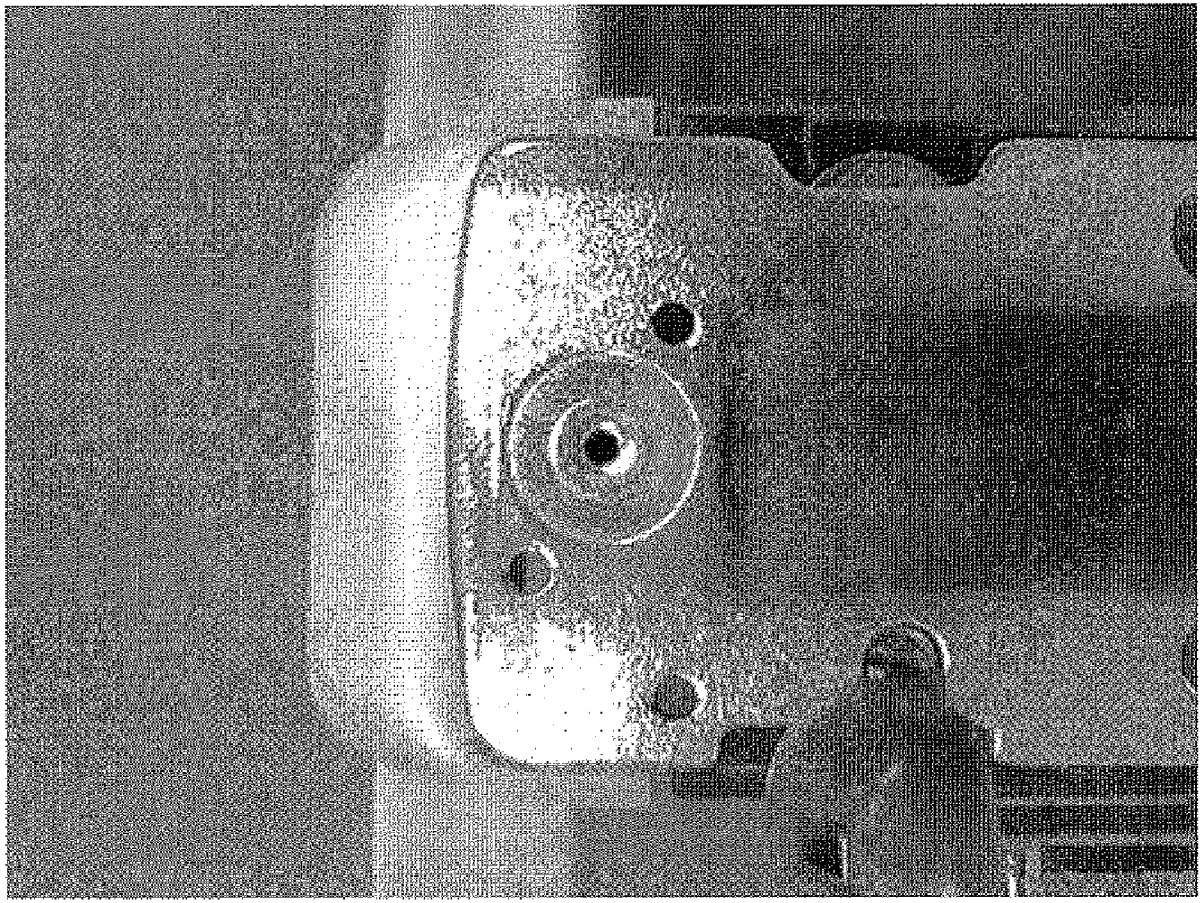
FIG. 14 is an explanatory figure of an image that has been captured by an image sensor when it is disposed in a position where a filter is not used.
Figure 15:
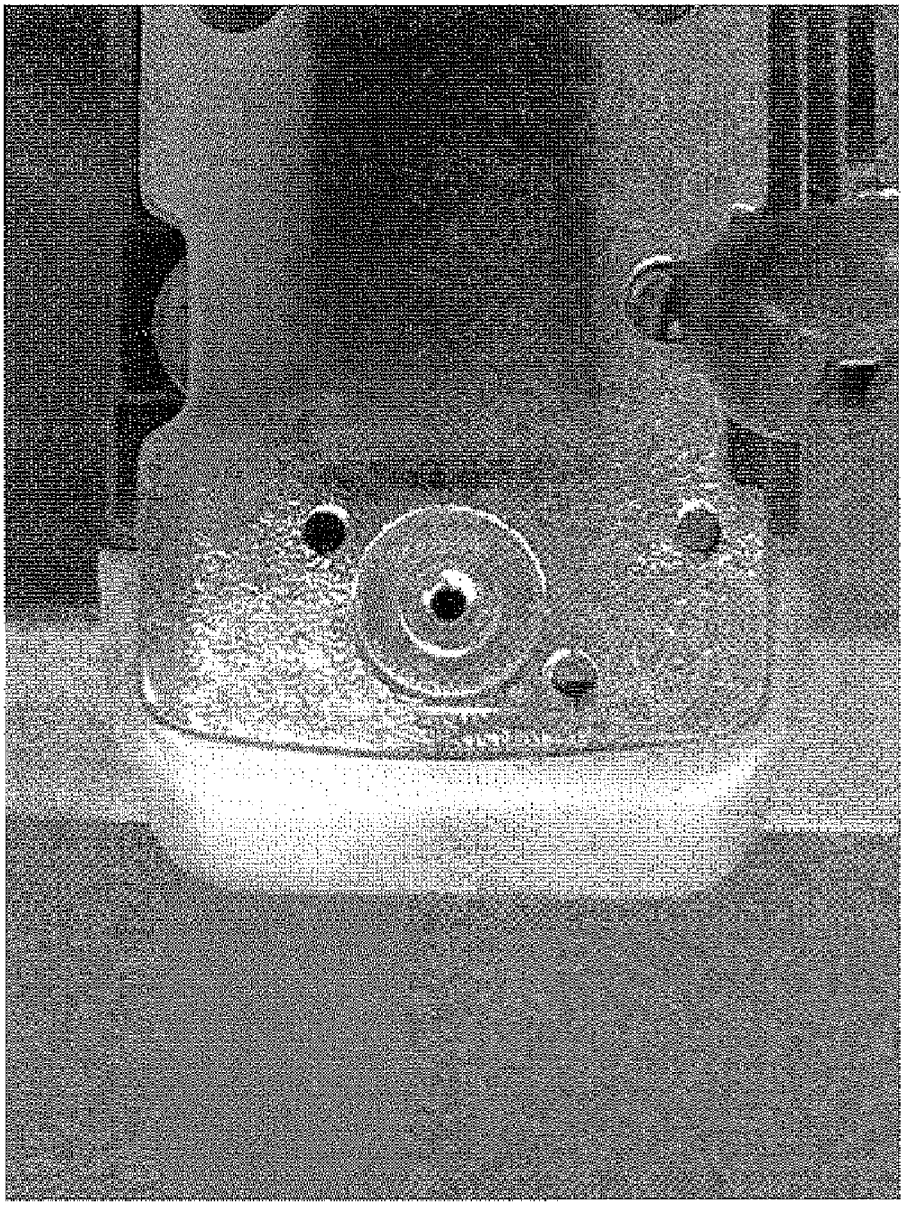
FIG. 15 is an explanatory figure of an image that has been captured by the image sensor when it is disposed in a filter use position.

Following whichever of Step S30 and Step S40 is performed, an image of the area around the needle drop point is captured by the image sensor 52 at a specified timing, and the generated image data are stored in the RAM 143 (Step S50). The specified timing may be, for example, the timing at which a command is input by the panel operation. Next, the image that is represented by the image data that have been generated at Step S50 is displayed on the LCD 7 (Step S60). In a case where the needle bar case 21 has moved at Step S40 to the position in FIG. 12, the image that is shown in FIG. 14, for example, is displayed on the LCD 7. In a case where the needle bar case 21 has moved at Step S30 to the position in FIG. 15, the image that is shown in FIG. 15, for example, is displayed on the LCD 7. Comparing FIGS. 14 and 15, it can be seen that in FIG. 15 there is less reflected light in the area around the needle hole 38 than in FIG. 14. Following Step S60, the image capture processing is terminated.

In the sewing machine 1, the positional relationship between the image sensor 52 and the filter 82 is switched automatically in accordance with the move command that is acquired at Step S10. Therefore, by inputting the move command, the user can easily acquire an image that is captured with the filter in use. The sewing machine 1 can switch the positional relationship between the image sensor 52 and the filter 82 to one of the filter use position (the first position) and the filter nonuse position (the second position), in conjunction with the moving of the needle bar case 21. In other words, the sewing machine 1 does not require a dedicated drive source for switching the positional relationship between the image sensor 52 and the filter 82. Therefore, the sewing machine 1 can switch the positional relationship between the image sensor 52 and the filter 82 using a configuration that is simpler than the configuration in a case where a dedicated drive source is provided separately from the needle bar case moving mechanism 40. For example, in a case where the sewing machine 1 captures an image of a work cloth that is shiny, there will be less light reflected by the work cloth in an image that is captured in the filter use position than in an image that is captured in the filter nonuse position. The user can therefore accurately ascertain the nature of the work cloth surface based on the image that is captured in the filter use position.

In the first embodiment, the position at which the image sensor 52 is disposed directly above the needle hole 38 is defined as the image capture position. Accordingly, there is less distortion in the image that is acquired by the image capture at Step S50 than in a case where an image is captured from a position that is diagonally above the needle drop point. Therefore, the user can easily recognize the needle drop point based on the image that is displayed on the LCD 7 at Step S60. Furthermore, because the distortion of the image that is captured at Step S50 is small, there is also small distortion in the coordinates within the image. Therefore, in a case where the sewing machine 1 determines a specified position within the image, such as the needle drop point or the like, for example, the sewing machine 1 can compute (the coordinates of) the specified position precisely.

A sewing machine 1 according to a second embodiment will be explained below. The sewing machine 1 according to the second embodiment is provided with a plurality of auxiliary optical members, and in accordance with a command from the user, the command specifies one of the auxiliary optical members among the plurality of the auxiliary optical members as a selected optical member, then disposes the selected optical member in the optical path of the image sensor 52.

The physical configuration of the sewing machine 1 according to the second embodiment is different from that of the sewing machine 1 according to the first embodiment in the optical member holding portion 80. The electrical configuration of the sewing machine 1 according to the second embodiment is the same as that of the sewing machine 1 according to the first embodiment. Explanations of the structural elements that are the same as in the sewing machine 1 according to the first embodiment will be omitted, and an optical member holding portion 180 according to the second embodiment will hereinafter be explained.

Figure 16:
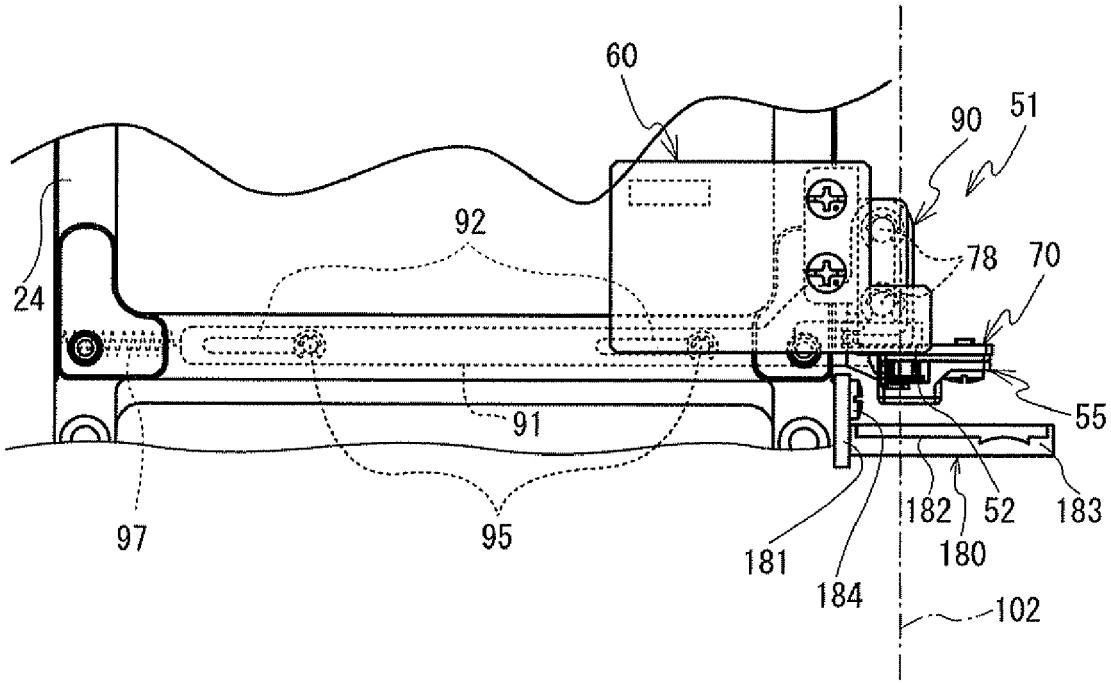
FIG. 16 is a front view of an optical member holding portion and the image sensor holding mechanism according to a modified example.

As shown in FIG. 16, the optical member holding portion 180 according to the second embodiment includes a support portion 181, a filter 182, an auxiliary lens 183, and a screw 184. The optical member holding portion 180 is secured to the frame 24 by the screw 184. The optical member holding portion 180 includes auxiliary optical members that are adapted to be disposed in the optical path of the image sensor 52 in accordance with a command from the user. The filter 182 includes a polarizing filter as an auxiliary optical member. The auxiliary lens 183 includes a fish-eye lens as an auxiliary optical member. The support portion 181 supports the filter 182 and the auxiliary lens 183 on the right side face of the frame 24. The support portion 181 is provided with a screw hole (not shown in the drawings) into which the screw 184 is inserted. The optical member holding portion 180 is secured by the screw 184 to the right side face of the frame 24 below the holding mechanism 51.

Image capture processing according to the second embodiment will be explained. The image capture processing according to the second embodiment is basically the same as the image capture processing according to the first embodiment that is shown in FIG. 9, so the explanation will be simplified. The CPU 141 that is shown in FIG. 8 performs the image capture processing that is shown in FIG. 9, in accordance with the image capture program that is stored in the ROM 142. The sewing machine 1 according to the second embodiment positions the image sensor 52 directly above the needle hole 38 (refer to FIG. 1) and acquires an image of the needle hole 38. The sewing machine 1 according to the second embodiment is adapted to capture the image from one of two image capture positions (a filter use position and an auxiliary lens use position) in which the positional relationship between the image sensor 52, the filter 182, and the auxiliary lens 183 are different. In the same manner as in the first embodiment, the filter use position is a position in which the filter 182 is disposed in the optical path of the image sensor 52. The auxiliary lens use position is a position in which the auxiliary lens 183 is disposed in the optical path of the image sensor 52. In the same manner as in the first embodiment, in a case where the image capture position is set to the filter use position, the sewing machine 1 moves the needle bar case 21 to the position in FIG. 10. In a case where the image capture position is set to the auxiliary lens use position, the sewing machine 1 moves the needle bar case 21 to the position in FIG. 12. The image capture position is determined in accordance with the selected optical member. The command that specifies the selected optical member is input by the panel operation as the move command.

Image capture processing according to the second embodiment will be explained in more detail. In the second embodiment, in the image capture processing that is shown in FIG. 9, in a case where the image capture position that is specified by the move command (a disposition command) that has acquired at Step S10 is the filter use position (YES at Step S20), the needle bar case 21 is moved to the position that is shown in FIG. 10 (Step S30). The processing at Step S30 is processing that is performed in a case where the filter 182 has been selected as the selected optical member. In the case where the needle bar case 21 is at the position in FIG. 10, the image sensor 52 is at the filter use position. At the filter use position, the filter 182 is disposed in the optical path of the image sensor 52. In contrast, in a case where the specified image capture position is the auxiliary lens use position (NO at Step S20), the needle bar case 21 is moved to the position that is shown in FIG. 12 (Step S40). The processing at Step S40 is processing that is performed in a case where the auxiliary lens 183 has been selected as the selected optical member. In the case where the needle bar case 21 is at the position in FIG. 12, the image sensor 52 is at the auxiliary lens use position. At the auxiliary lens use position, the auxiliary lens 183 is disposed in the optical path of the image sensor 52. Following whichever of Step S30 and Step S40 is performed, Step S50 is performed, and the image that is acquired at the selected position at Step S50 is displayed on the LCD 7 (Step S60).

The selected optical member that is selected by the user can be automatically disposed in the optical path of the image sensor 52 in accordance with the move command (the disposition command) that is acquired at Step S10. It is therefore possible for the user to dispose the desired auxiliary optical member in the optical path of the image sensor 52 by the simple operation of inputting the move command (the disposition command). Note that in the sewing machine 1 according to the second embodiment, the shape of the cover 23 may also be changed such that the two auxiliary optical members are both covered by the cover 23.

The sewing system of the present disclosure is not limited to the embodiment that is described above, and various types of modifications may be made within the scope of the present disclosure. For example, the modifications that are described below from (A) to (H) may be made as desired.

(A) The type of the image sensor 52 may be changed as desired. The image sensor 151 may also be an image capture element other than a CMOS image sensor, such as a CCD camera or the like, for example.

(B) The position in which the image sensor 52 is disposed may be changed as desired. For example, the image sensor 52 may be disposed as in any one of (B-1) to (B-4) below.

(B-1) For example, the image sensor 52 may be disposed on the left side of the needle bar case 21 instead of on the right side. As another example, the image sensor 52 may be disposed in a position that is located between a plurality of the needle bars 31. More specifically, for example, the image sensor 52 may be disposed within the frame 24 of the needle bar case 21 that is shown in FIG. 2, between a needle bar number three that is the third from the right and a needle bar number four that is the fourth from the right. In this case, the distance between the image sensor 52 and the needle bar 31 that is in the position that is the farthest from the image sensor 52 (the needle bar 31 that is the farthest toward the outer side) can be shortened. Therefore, in this case, it is possible to shorten the distance that the needle bar case 21 is moved when the image sensor 52 is moved from the sewing position to the image capture position.

(B-2) In the embodiments that are described above, the distance between the image sensor 52 and the needle bar 31 that is adjacent to the image sensor 52 is an integer multiple of the interval X between the needle bars 31. However, the distance between the image sensor 52 and the adjacent needle bar 31 may also be a value other than an integer multiple of the interval X. Further, in the embodiments that are described above, the needle bar case 21 stops at a position that is one of nine positions, depending on which of the engaging rollers 42 is engaged with the positioning portion 481 of the helical cam 48, but the positions at which the needle bar case 21 stops are not limited to these examples. For example, the sewing machine may also be adapted to stop the needle bar case 21 at any desired position within the range of movement of the needle bar case 21.

(B-3) In the embodiments that are described above, the central axis lines of the plurality of the needle bars 31 and the image sensor 52 are disposed along a single straight line in a plan view. This makes it possible for the sewing machine 1 to move the image sensor 52 easily to the position that is directly above the needle drop point. However, in a multi-needle sewing machine in which a travel path of a needle bar case is arc-shaped in a plan view, for example, needle bars and an image sensor may also be disposed in an arc shape, such that the image sensor also travels along an arc-shaped travel path, together with the needle bars.

(B-4) In the embodiments that are described above, the image capture direction of the image sensor 52 is set to one of facing downward and facing forward, but the image capture direction can be changed as desired.

(C) The types, the number, and the attachment positions of the auxiliary optical members with which the sewing machine 1 is provided can each be changed as desired. For example, the sewing machine 1 may be provided with at least one of a filter, an auxiliary lens, and a prism as the at least one auxiliary optical member. A color filter, for example may be provided as the filter. A fish-eye lens or a wide-angle lens may be provided as the auxiliary lens, for example. As another example, the optical member holding portions 80, 180 may be made removable. Yet another example is that a plurality of the auxiliary optical members may be disposed in the optical path of the image sensor 52 at the same time.

(D) In the first embodiment that is described above, at Step S40 in the image capture processing that is shown in FIG. 9, the sewing machine 1 switches the positional relationship between the image sensor 52 and the filter 82 by maintaining the position of the image sensor 52 in relation to the body 20 and changing the position of the optical member holding portion 80 in relation to body 20. However, the sewing machine 1 may also switch the positional relationship between the image sensor 52 and the filter 82 by using another method. For example, the sewing machine 1 may also switch the positional relationship between the image sensor 52 and the filter 82 by changing the position of the image sensor 52 in relation to body 20.

(E) In the sewing machine 1 in the embodiments that are described above, the image capture processing that is performed can be changed as desired. For example, in the embodiments that are described above, the position of the image sensor 52 when the image capture processing starts is assumed to be the sewing position, in order to simplify the explanation, but any desired position may be set as the position of the image sensor 52 when the image capture processing starts. Furthermore, the sewing machine 1 may also switch the image capture conditions for the image sensor 52 at any time, in accordance with a command that the user inputs to the sewing machine 1, for example. Specifically, in the image capture processing according to the first embodiment that is shown in FIG. 9, for example, the sewing machine 1 may also switch the image capture position of the image sensor 52 from the filter use position to the filter nonuse position, and from the filter nonuse position to the filter use position, in accordance with a command that the user inputs to the sewing machine 1. To take another example, the method for acquiring the command at Step S10 can be changed as desired. More specifically, the command may also be input by a dedicated button with which the sewing machine is provided. As yet another example, in the embodiments that are described above, at Step S60 in the image capture processing that is shown in FIG. 9, the image that is captured by the image sensor 52 is displayed on the LCD 7. However, the image that is captured by the image sensor 52 at Step S50 may also be used for other processing.

(F) In the first embodiment, one of the filter use position and the filter nonuse position is specified as the image capture position at Step S20. In addition, in the second embodiment, one of the filter use position and the auxiliary lens use position is specified as the image capture position at Step S20. However, the nature and the number of the image capture positions can be changed as desired in accordance with the auxiliary optical members with which the sewing machine 1 is provided. For example, in addition to the filter use position and the auxiliary lens use position, a position may also be set where neither the filter nor the auxiliary lens is used, where both the filter 182 and the auxiliary lens 183 are moved out of the optical path of the image sensor 52. In that case, the sewing machine 1 could capture an image in the position where neither the filter nor the auxiliary lens is used by using a configuration like that hereinafter described. The needle bar case moving mechanism is provided with a tenth engaging roller 42 in a position that is the distance X to the right of the engaging roller 42 that is shown as the farthest to the right in FIG. 4. A guide hole in a guide plate according to a modified example is longer in the rightward direction, by the distance X, than the guide hole 92 in the guide plate 90 in FIG. 6. Then in a case where the position where neither the filter nor the auxiliary lens is used is selected by the user as the image capture position, the sewing machine 1 moves the needle bar case 21 to a position where the engaging roller 42 that is the farthest to the right engages the positioning portion 481 of the helical cam 48.

(G) The configurations of the sewing machine 1 can be changed as desired. In a case where the present disclosure is applied to a multi-needle sewing machine like the sewing machine 1, the number of the needle bars is not limited to being six and needs only to be a plurality. To take another example, the needle bar case moving mechanism 40 may also be driven manually by the user. As yet another example, the sewing machine 1 may also be configured such that the one of the image sensor 52 and the optical member holding portion 80 is moved using an actuator as a drive source. The configuration of the holding mechanism 51 that includes the sensor base plate 70 and the guide plate 90 may be changed as desired. Another example would be that the present disclosure may also be applied to a sewing machine other than a multi-needle sewing machine. Yet another example would be that each of the movable range 500, the holding range 501, and the switching range 502 of the needle bar case 21 can be changed as desired, in accordance with the configuration of the sewing machine 1.

Figure 17:
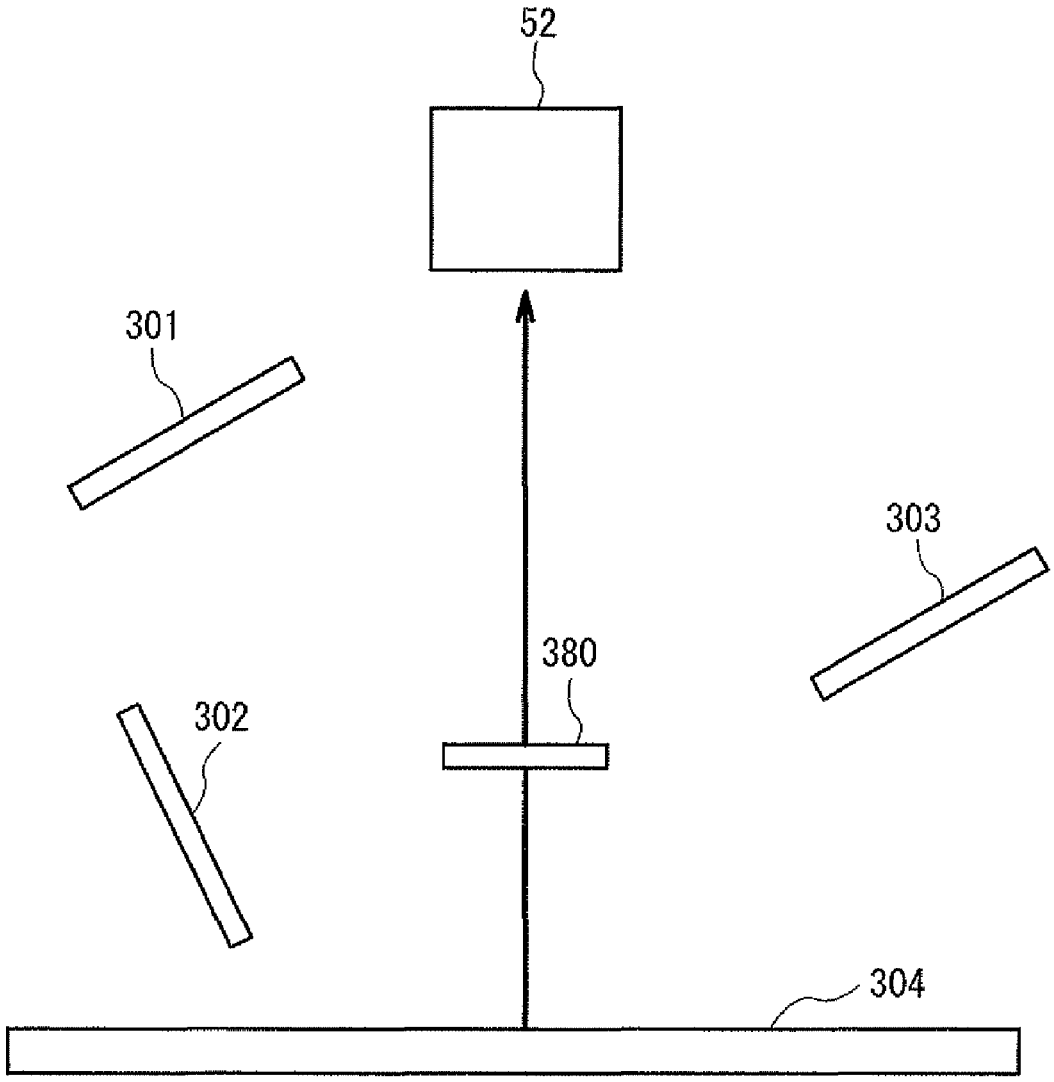
FIG. 17 is a figure for explaining an optical path that passes through the optical member holding portion in the modified example.
Figure 18:
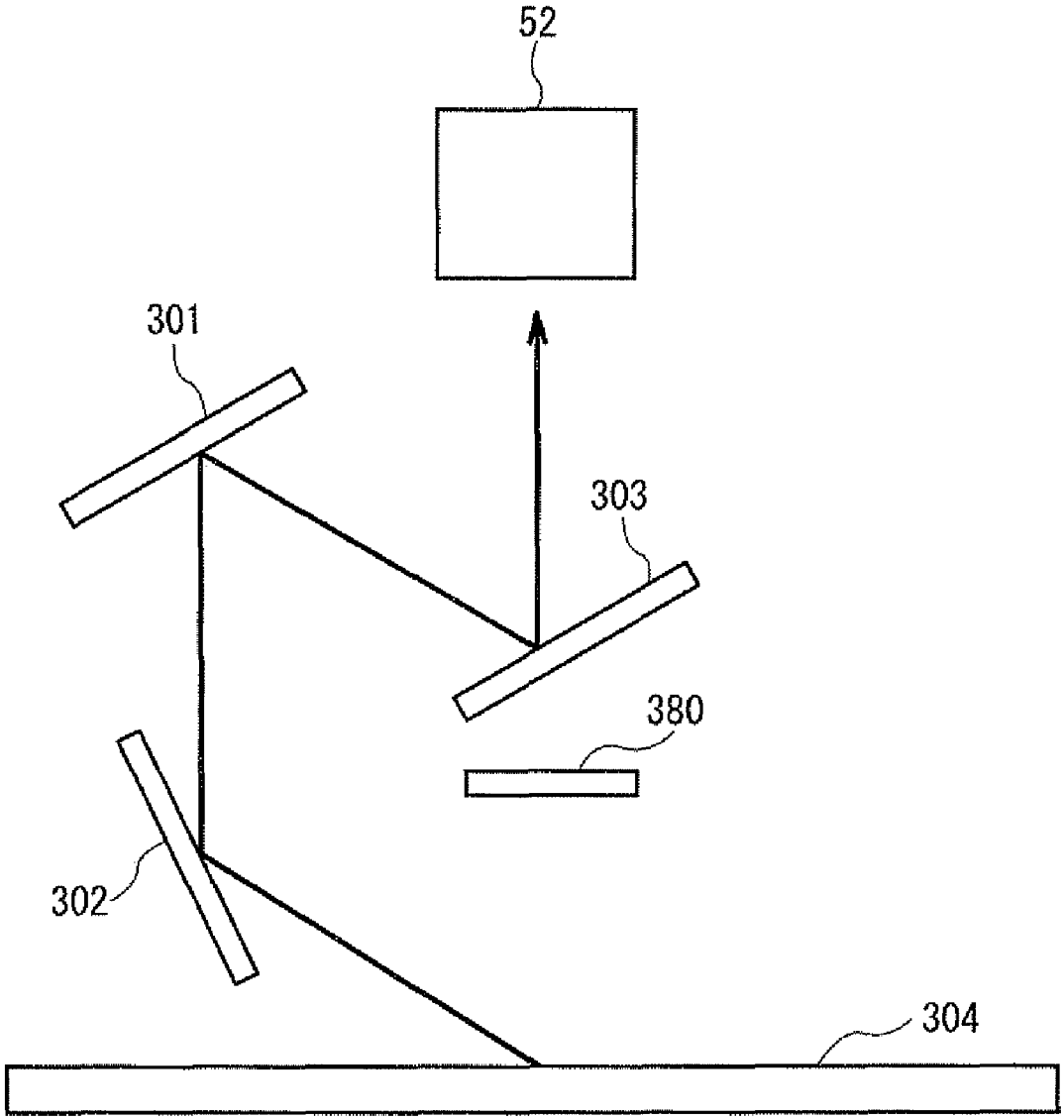
FIG. 18 is a figure for explaining an optical path that circumvents the optical member holding portion in the modified example.

(H) The positional relationship between the image sensor 52 and the optical member holding portion 80 may also remain fixed, and the optical path to the image sensor 52 may be switched using an optical path changing member. As one example, a modified example in which a movable mirror 303 is used as the optical path changing member to switch the optical path that extends from a work cloth 304 held by the embroidery frame 39 (not shown in FIGS. 17 and 18) to the image sensor 52 will be explained with reference to FIGS. 17 and 18. As shown in FIGS. 17 and 18, a sewing machine according to the modified example is provided with a plurality of mirrors 301 to 303, the image sensor 52, and an auxiliary optical member 380. The positional relationship between the image sensor 52 and the auxiliary optical member 380 is fixed. The relative positions of fixed mirrors 301, 302 in relation to the image sensor 52 are fixed. The relative position of the movable mirror 303 in relation to the image sensor 52 can be switched by a switching device. The movable mirror 303 may be attached to the frame 24, for example. Each of the fixed mirrors 301, 302, the image sensor 52, and the auxiliary optical member 380 may be attached to the body 20, for example. In image capture processing that is the same as the image capture processing according to the first embodiment that is shown in FIG. 9, in a case where the specified image capture position is the filter use position (YES at Step S20), the movable mirror 303 is moved to the position (a second position) that is shown in FIG. 17. In FIG. 17, the plurality of the mirrors 301 to 303 have all been moved out from between the image sensor 52 and the auxiliary optical member 380. In this case, the light that passes through the auxiliary optical member 380 enters the lens of the image sensor 52.

In a case where the specified image capture position is the filter nonuse position (NO at Step S20), the movable mirror 303 is moved to the position (a first position) that is shown in FIG. 18. In this case, the light that passes through the auxiliary optical member does not enter the lens of the image sensor 52. The light that is reflected by the plurality of the mirrors 310 to 303 enters the image sensor 52. In the modified example, in a case where the auxiliary optical member 380 is switched to one of being used and not being used, the length of the optical path one of increases and decreases, so processing is performed that automatically changes the focal point of the image sensor 52. In the case that is shown in FIG. 18, an image that is based on data that are generated by the image sensor 52 is an image that has been captured from diagonally above the subject. Therefore, the image data may also be corrected such that the image will become the same as an image that is acquired in a case where the image is captured in the state that is shown in FIG. 17. In another example, a hologram may be provided in which the diagonal image is corrected before the light that is reflected by the mirrors reaches the image sensor 52. In the modified example, the auxiliary optical member 380 can be switched to one of being used and not being used on the assumption that the positional relationship between the image sensor 52 and the auxiliary optical member 380 is fixed. In another modified example, an auxiliary optical member may be switched to one of being used and not being used by disposing a plurality of mirrors between the image sensor 52 and the auxiliary optical member 380.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine, comprising:

a bed;

a needle plate that is provided on the bed and includes a needle hole;

an image capture device that is adapted to capture an image facing downward from above the needle hole;

an auxiliary optical member that is adapted to receive light and to let the received light pass through to an image capture device side of the auxiliary optical member;

a switching device that switches the auxiliary optical member to one of being used and not being used;

a command acquisition device that acquires a command to switch the auxiliary optical member to one of being used and not being used; and a control device that, in a case where the command has been acquired by the command acquisition device, controls the switching device to switch the auxiliary optical member to one of being used and not being used in accordance with the command, wherein:

the switching device moves at least one of the auxiliary optical member and the image capture device to switch a positional relationship between the auxiliary optical member and the image capture device to one of at least a first position and a second position, the first position being a position in which the auxiliary optical member is disposed in an optical path of the image capture device, the second position being a position in which the auxiliary optical member is outside of the optical path, the optical path extending from the image capture device to an object whose image is to be captured; and the control device, in a case where the command has been acquired by the command acquisition device, controls the switching device to switch the positional relationship in accordance with the command automatically.

2. The sewing machine according to claim 1, wherein:

the auxiliary optical member is provided as a plurality of auxiliary optical members; and the control device, in a case where a disposition command to switch the positional relationship between the image capture device and a selected optical member to the first position has been acquired as the command by the command acquisition device, controls the switching device to move at least one of the selected optical member and the image capture device to switch the positional relationship between the selected optical member and the image capture device to the first position, the selected optical member being a selected one of the plurality of the auxiliary optical members.

3. The sewing machine according to claim 1, further comprising:

a body;

a plurality of needle bars; and a needle bar case that contains the plurality of the needle bars, wherein:

the auxiliary optical member is secured to the needle bar case;

the switching device includes:

a needle bar case moving mechanism that moves the needle bar case in a horizontal direction in relation to the body; and a coupling member that couples the image capture device to the needle bar case and moves the image capture device in conjunction with the moving of the needle bar case, the control device controls the needle bar case moving mechanism in accordance with the command that has been acquired by the command acquisition device to move the needle bar case; and the coupling member operates in conjunction with the moving of the needle bar case to switch the positional relationship.

4. The sewing machine according to claim 1, wherein:

the auxiliary optical member is at least one of an auxiliary lens and a filter.

5. The sewing machine according to claim 3, wherein:

the coupling member supports the image capture device and is slidably supported by the needle bar case;

a possible range of movement of the needle bar case includes a switching range in which the coupling member is in contact with the body and slides in relation to the needle bar case to change the positional relationship; and the control device controls the needle bar case moving mechanism to move the needle bar case within a range that includes at least a portion of the switching range, in accordance with the command that has been acquired by the command acquisition device.

6. The sewing machine according to claim 1, further comprising:

an optical path changing member that is adapted to change an optical path to the image capture device, wherein:

the switching device moves the optical path changing member to switch a positional relationship between the optical path changing member and the image capture device to one of a first position and a second position, the first position being a position in which the auxiliary optical member is disposed in the optical path of the image capture device, the second position being a position in which the optical path changing member is out from the optical path of the image capture device;

the command acquisition device acquires, as the command, a switching command to switch a positional relationship between the optical path changing member and the image capture device by the switching device; and the control device, in a case where the switching command has been acquired by the command acquisition device, controls the switching device to switch the positional relationship.

7. A computer-readable medium storing a control program executable on a sewing machine that includes a bed, with a needle plate that is provided on the bed and includes a needle hole, and with an image capture device that is capable of capturing an image facing downward from above the needle hole, the program comprising instructions that cause a controller of the sewing machine to perform the steps of:

acquiring a command to switch an auxiliary optical member that receives light and lets light pass through to an image capture device side of the auxiliary optical member to one of being used and not being used in a case where the command has been acquired, a switching device being controlled to move at least one of the auxiliary optical member and the image capture device to one of a first position and a second position in accordance with the command to switch a positional relationship between the auxiliary optical member and the image capture device, the first position being a position in which the auxiliary optical member is disposed in an optical path of the image capture device, the second position being a position in which the auxiliary optical member is outside of the optical path, the optical path extending from the image capture device to an object whose image is to be captured; and controlling, in a case where the command has been acquired, a switching device that switches the auxiliary optical member to one of being used and not being used to switch the auxiliary optical member to one of being used and not being used in accordance with the command automatically.

* * * * *